US008900783B2

(12) United States Patent
Nukada et al.

(10) Patent No.: US 8,900,783 B2
(45) Date of Patent: Dec. 2, 2014

(54) ELECTROPHOTOGRAPHIC PHOTORECEPTOR, PROCESS CARTRIDGE, AND IMAGE FORMING APPARATUS

(71) Applicant: Fuji Xerox Co., Ltd., Tokyo (JP)

(72) Inventors: Katsumi Nukada, Kanagawa (JP); Wataru Yamada, Kanagawa (JP); Hidekazu Hirose, Kanagawa (JP); Yuko Iwadate, Kanagawa (JP); Kenji Kajiwara, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/973,553

(22) Filed: Aug. 22, 2013

(65) Prior Publication Data

US 2014/0255835 A1 Sep. 11, 2014

(30) Foreign Application Priority Data

Mar. 5, 2013 (JP) ..... 2013-043511

(51) Int. Cl.
*G03G 8/00* (2006.01)
*G03G 7/00* (2006.01)

(52) U.S. Cl.
CPC ..... *G03G 7/004* (2013.01)
USPC ..... 430/66

(58) Field of Classification Search
USPC ..... 430/66
See application file for complete search history.

(56) References Cited

U.S. PATENT DOCUMENTS

| | | | |
|---|---|---|---|
| 5,374,494 | A | 12/1994 | Kashimura et al. |
| 5,411,827 | A | 5/1995 | Tamura et al. |
| 5,427,880 | A | 6/1995 | Tamura et al. |
| 5,496,671 | A | 3/1996 | Tamura et al. |
| 6,372,397 | B1 | 4/2002 | Maruyama et al. |
| 2004/0043312 | A1 | 3/2004 | Kikuchi et al. |
| 2004/0248024 | A1 | 12/2004 | Suzuki et al. |
| 2004/0253527 | A1 | 12/2004 | Suzuki et al. |
| 2007/0122724 | A1 | 5/2007 | Suzuki et al. |
| 2007/0178400 | A1 | 8/2007 | Kikuchi et al. |
| 2008/0020305 | A1 | 1/2008 | Suzuki et al. |
| 2011/0229809 | A1 * | 9/2011 | Nukada et al. ..... 430/56 |

FOREIGN PATENT DOCUMENTS

| | | |
|---|---|---|
| JP | A-05-040360 | 2/1993 |
| JP | A-05-088399 | 4/1993 |
| JP | A-05-216249 | 8/1993 |
| JP | A-07-072640 | 3/1995 |

(Continued)

*Primary Examiner* — Hoa V Le
(74) *Attorney, Agent, or Firm* — Oliff PLC

(57) ABSTRACT

An electrophotographic photoreceptor includes an electroconductive substrate; a photosensitive layer that is provided on the electroconductive substrate; and an outermost surface layer, wherein the outermost surface layer is a layer made of a cured product of a composition that contains position isomer mixture of at least one kind among non-charge transporting compounds represented by Formulae (I) and (II) and at least one kind among non-reactive charge transporting materials.

(I)

(II)

9 Claims, 6 Drawing Sheets

(56) References Cited

FOREIGN PATENT DOCUMENTS

| | | |
|---|---|---|
| JP | B2-2852464 | 2/1999 |
| JP | A-2000-206715 | 7/2000 |
| JP | A-2000-206717 | 7/2000 |
| JP | A-2000-258932 | 9/2000 |
| JP | A-2001-166509 | 6/2001 |
| JP | A-2001-175016 | 6/2001 |
| JP | A-2004-012986 | 1/2004 |
| JP | A-2004-302450 | 10/2004 |
| JP | A-2005-062301 | 3/2005 |
| JP | A-2005-062302 | 3/2005 |
| JP | A-2006-098728 | 4/2006 |
| JP | A-2006-138956 | 6/2006 |
| JP | A-2007-086522 | 4/2007 |

* cited by examiner

ELECTROPHOTOGRAPHIC PHOTORECEPTOR, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2013-043511 filed Mar. 5, 2013.

BACKGROUND

1. Technical Field

The present invention relates to an electrophotographic photoreceptor, a process cartridge, and an image forming apparatus.

2. Related Art

Generally, an electrophotographic image forming apparatus has the following configurations and processes.

That is, a surface of an electrophotographic photoreceptor is charged to desired polarity and potential by a charging unit, and the charge is selectively erased from a charged surface of the electrophotographic photoreceptor by image-wise exposure, thereby forming an electrostatic latent image. The latent image is then developed into a toner image by adhering a toner to the electrostatic latent image by a developing unit, the toner image is transferred onto a transfer medium by a transfer unit, and then the transfer medium is discharged as an image formed material.

Electrophotographic photoreceptors are currently been increasingly used in the field of copying machines, laser beam printers, and the like due to advantages of obtaining high printing quality with a high speed.

As electrophotographic photoreceptors used in image forming apparatus, electrophotographic photoreceptors used in the related art, using inorganic photoconductive materials such as selenium, selenium-tellurium alloy, selenium-arsenic alloy, and cadmium sulfide (inorganic photoreceptors) have been known, but recently, organic photoreceptors using organic photoconductive materials having superior advantages in views of low cost, manufacturability, and disposability (organic photoreceptors) are mainly used.

As a charging system that charges the surface of an electrophotographic photoreceptor, a corona charging system utilizing a corona discharger has been used in the related art. However, a contact charging system having advantages such as low ozone production and low electricity consumption has recently been put into practical use and is widely used. In this contact charging system, the surface of a photoreceptor is charged by bringing an electroconductive member as a charging member into contact with, or in close proximity to, the surface of the photoreceptor, and applying a voltage to the charging member. As a system for applying a voltage to the charging member, there are a direct current system in which only a direct current voltage is applied, and an alternating current superimposition system in which a direct current voltage superimposed by an alternating current voltage is applied. The contact charging system has advantages of downsizing the apparatus as well as suppressing generation of gases such as ozone.

As a transfer system that transfers a toner image onto a transfer medium, a system in which a toner image is transferred directly to paper has been mainly used, but a system of transferring a toner image to paper via an intermediate transfer member is frequently used in recent years due to a wider variety of types of paper for transfer.

Furthermore, in order to obtain a high-resolution image, investigations are recently conducted to obtain a more precise image by providing a toner with a small diameter. It is preferable to make a toner with a small diameter for the purpose of obtaining a high-precision image, but as the diameter of the toner decreases, the transfer to a transfer medium from a photoreceptor becomes difficult. Hence, for example, a method is taken, in which a pressing pressure between the photoreceptor and the transfer medium is increased or some differences in peripheral speeds between the photoreceptor and the transfer medium are given to make an easier mechanic transfer. As the transfer medium, a flexible belt is generally used, but it is apparent that there is still a desire for a long lifetime of the belt, such as low dependency of a resistance value on environment, a less tensile stretch, high fracture strength such as cracks, and high abrasion resistance. In this regard, a high-strength polyimide is used in many cases. The polyimide has a significantly high strength, and thus, a unit for improving the transfer efficiency of the toner is accompanied by a significantly high stress on a photoreceptor facing the unit. In addition, it is often difficult to remove the toner remaining on the photoreceptor, so-called cleaning, and thus, for example, a method for increasing the pressing pressure of a cleaning blade onto the photoreceptor is taken. This causes mechanic friction on the surface of the photoreceptor. This mechanical stress brings about an increase in the cutting of the surface layer of the photoreceptor, which is a main cause of making the lifetime of the photoreceptor shorter, and a photoreceptor excellent in the mechanic strength is critical for a long lifetime and high reliability.

In order to attain a longer lifetime and higher reliability of the electrophotographic photoreceptor, it has been proposed to provide a protective layer on the surface of an electrophotographic photoreceptor to improve the strength.

The materials for forming a protective layer have been proposed.

SUMMARY

According to an aspect of the invention, there is provided an electrophotographic photoreceptor including:

an electroconductive substrate;

a photosensitive layer that is provided on the electroconductive substrate; and an outermost surface layer, wherein the outermost surface layer is a layer made of a cured product of a composition that contains position isomer mixture of at least one kind among non-charge transporting compounds represented by Formulae (I) and (II) and at least one kind among non-reactive charge transporting materials:

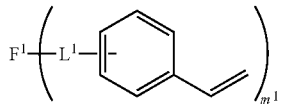

(I)

wherein in Formula (I), $F^1$ represents an $m^1$-valent organic group that does not have a charge transporting property and contains an aromatic ring; $L^1$ represents a divalent linking group that contains at least one kind selected from —C(=O)—O— and —O—; and $m^1$ represents an integer of 3 or more, (II)

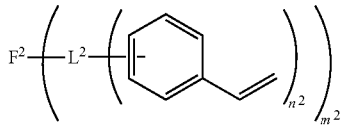

wherein in Formula (II), $F^2$ represents an $m^2$-valent organic group that does hot have a charge transporting property and contains an aromatic ring; $L^2$ represents a $(n^2+1)$-valent linking group that contains at least one kind selected from —C(═O)—O— and —O—; $m^2$ represents an integer of 2 or more; and $n^2$ represents an integer of from 2 to 3.

BRIEF DESCRIPTION OF THE DRAWINGS

Exemplary embodiments of the present invention will be described in detail based on the following figures, wherein.

DETAILED DESCRIPTION

Figure 1:
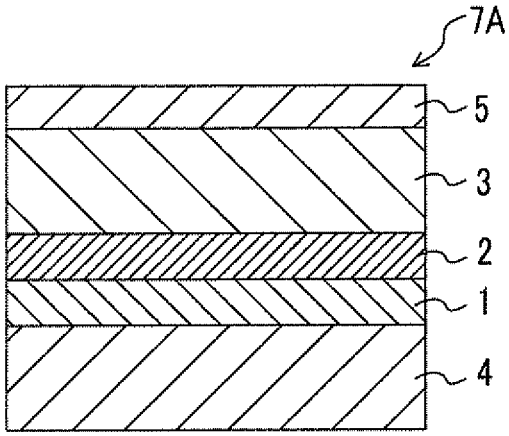
FIG. 1 is a schematic cross-sectional view showing an example of the layer configuration of the electrophotographic photoreceptor according to the present exemplary embodiment.

Hereinbelow, the present exemplary embodiment which is one example of the invention will be described.

Electrophotographic Photoreceptor

An electrophotographic photoreceptor according to the exemplary embodiment includes an electroconductive substrate and a photosensitive layer provided on the electroconductive substrate.

In addition, the outermost surface layer is a layer configured by a cured product of a composition which contains position isomer mixture of at least one kind among non-charge transporting compounds represented by Formulae (I) and (II) (hereinafter, referred to as "specific non-charge transporting compounds" in some cases) and at least one kind among non-reactive charge transporting materials.

In addition, the position isomer mixture of at least one kind among the specific non-charge transporting compounds will be collectively referred to as "specific position isomer mixture" in some cases.

Here, the outermost surface layer may form an outermost surface of the electrophotographic photoreceptor itself, and is provided as a layer that functions as a protective layer or a layer that functions as a charge transporting layer. In the case where the outermost surface layer is a layer that functions as a protective layer, the lower layer of the protective layer is a photosensitive layer including a charge transporting layer and a charge generating layer, or a single-layer type photosensitive layer.

Specifically, in the case where the outermost surface layer is a layer that functions as a protective layer, there may be an exemplary embodiment in which a photosensitive layer (a charge generating layer and a charge transporting layer, or single-layer type photosensitive layer), and a protective layer as an outermost surface layer are provided in this order on an electroconductive substrate. On the other hand, in the case where the outermost surface layer is a layer that functions as a charge transporting layer, there may be an exemplary embodiment in which a charge generating layer, and a charge transporting layer as an outermost surface layer are formed in this order on an electroconductive substrate.

The electrophotographic photoreceptor according to the present exemplary embodiment is an electrophotographic photoreceptor having an outermost surface layer excellent in electrical characteristics and abrasion resistance by the configuration above.

The reason therefor is not clear, but is contemplated to be as follows.

First, the specific non-charge transporting compound is a monomer with three or more functional groups, which contains three or more styryl groups, and therefore, it is considered that a symmetric property easily breaks as compared with a monomer with two functional groups and that solubility with respect to a solvent tends to increase. For this reason, it is considered that the specific non-charge transporting compound has excellent solubility in an application liquid in a case where the compound is applied as a component of the outermost surface layer and that the compound is not easily crystallized when cross-linked in the layer.

In addition, it is considered that the specific non-charge transporting compound has excellent compatibility with the non-reactive charge transporting material due to the above configuration. For this reason, it is considered that the non-reactive charge transporting material is not easily localized in the specific non-charge transporting compound which has been cross-linked in a state where crystallization is suppressed.

Furthermore, the specific position isomer mixture is a mixture of the monomers with three or more functional groups, which contains three or more styryl groups, and at the same time, a mixture of specific non-charge transporting compounds in a relationship of position isomer, in which positions of vinyl groups substituted with benzene rings of the styryl groups are different.

For this reason, it is considered that the specific position isomer mixture easily becomes an aggregate of compounds with no more symmetric properties as compared with a specific non-charge transporting compound other than the specific position isomer mixture and that solubility with respect to the solvent tends to be further enhanced.

Accordingly, it is considered that the specific position isomer mixture is not easily crystallized when cross-linked in the layer in a case where the specific position isomer mixture is applied as a component of the outermost surface layer.

In addition, it is considered that the specific position isomer mixture has excellent compatibility with the non-reactive charge transporting material due to the above structure. For this reason, it is considered that the non-reactive charge transporting material is not easily localized in the specific position isomer mixture which has been cross-linked in a state where crystallization is suppressed.

As a result, it is considered that the layer configured by the cured product of the composition which contains the specific position isomer mixture and at least one kind among the non-reactive charge transporting materials becomes a layer in which localization of the non-reactive charge transporting material is suppressed and a charge transporting path is uniformly formed and that the electric property is enhanced.

In addition, it is considered that the bonding amount between the specific non-charge transporting compounds increases and the strength of the layer is enhanced since the layer with the above configuration is cured in a state where crystallization of the specific position isomer mixture is suppressed.

In addition, it is considered that the strength of the layer with the above configuration tends to be enhanced since the specific position isomer mixture is a mixture of a monomer with three or more functional groups, which contains three or more styryl groups.

Furthermore, selectivity of application liquid solvent when the electrophotographic photoreceptor according to the exemplary embodiment is manufactured is enhanced due to the above configuration.

As described above, the electrophotographic photoreceptor according to the present exemplary embodiment is an electrophotographic photoreceptor having an outermost surface layer excellent in electrical characteristics and abrasion resistance.

Furthermore, it is contemplated that with an image forming apparatus (or process cartridge) including the electrophotographic photoreceptor according to the present exemplary embodiment, an image having high quality is maintained when the image is repeatedly formed.

Moreover, the electrophotographic photoreceptor according to the present exemplary embodiment has combination of electrical characteristics and abrasion resistance, thickening of the outermost surface layer (for example, having a large thickness of 7 μm or more) is achieved, and thus, the lifetime of the photoreceptor is increased. Since the lifetime of the photoreceptor is determined when the outermost surface layer is worn out, thickening of the outermost surface layer is effective for a long lifetime.

Furthermore, when the electrophotographic photoreceptor may be used as charged by discharge, at which an electrical load and a load by a discharge gas (for example, ozone) cause deterioration of the constituent materials of the outermost surface layer, and as a result, the discharge product (for example, ionic materials such as ammonium nitrate) is easily adsorbed. Therefore, particularly, moisture is adsorbed under high humidity, the surface resistance on the outermost surface layer decreases, leading to latent image bleeding. As a result, the image deletion easily occurs. In order to suppress the occurrence, is necessary that the outermost surface layer be worn moderately, thereby suppressing the latent image bleeding. This wear level is greatly affected by a charging type, a cleaning type, a toner shape, or the like, and significantly dependent on the systems, and thus, it is necessary to adjust the strength of the outermost surface layer. In this regard, with the electrophotographic photoreceptor according to the present exemplary embodiment, for example, by choosing the type and amount of unreacted reactive compounds, the type and amount of non-reactive charge transporting material, and a curing method, adjustment of the mechanical strength (abrasion resistance) of the outermost surface layer is achieved. As a result, even when the image is repeatedly formed, an image having high image quality is maintained.

Hereinafter, the electrophotographic photoreceptor according to the present exemplary embodiment in the case where the outermost surface layer is a layer that functions as a protective layer will be described in detail with reference to the drawings. In the drawings, the same symbols are provided to the same or corresponding parts, and the overlapping explanations are omitted.

Figure 2:
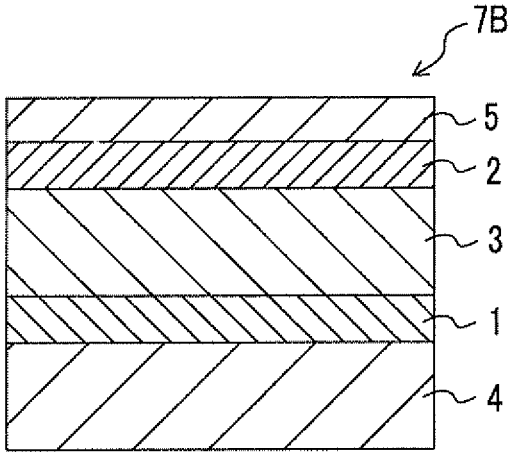
FIG. 2 is a schematic partial cross-sectional view showing another example of the layer configuration of the electrophotographic photoreceptor according to the present exemplary embodiment.
Figure 3:
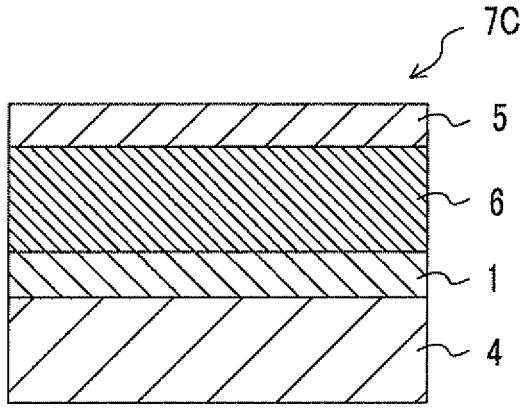
FIG. 3 is a schematic partial cross-sectional view showing still another example of the layer configuration of the electrophotographic photoreceptor according to the present exemplary embodiment.

FIG. 1 is a schematic cross-sectional view showing an example of the electrophotographic photoreceptor according to the present exemplary embodiment. FIGS. 2 and 3 are each a schematic cross-sectional view showing another example of the electrophotographic photoreceptor according to the present exemplary embodiment.

The electrophotographic photoreceptor 7A as shown in FIG. 1 is so-called a function separation type photoreceptor (or a multi-layer type photoreceptor), which has a structure including an undercoat layer 1 provided on an electroconductive substrate 4, and having a charge generating layer 2, a charge transporting layer 3, and a protective layer 5 formed in this order thereon. In the electrophotographic photoreceptor 7A, a photosensitive layer is constituted with a charge generating layer 2 and a charge transporting layer 3.

The electrophotographic photoreceptor 7B shown in FIG. 2 is a function separation type photoreceptor similar to the electrophotographic photoreceptor 7A shown in FIG. 1, in which the functions are separated to the charge generating layer 2 and the charge transporting layer 3.

The electrophotographic photoreceptor 7B shown in FIG. 2 has a structure including an undercoat layer 1 provided on an electroconductive substrate 4, and having a charge transporting layer 3, a charge generating layer 2, and a protective layer 5 in this order thereon. In the electrophotographic photoreceptor 7B, a photosensitive layer is constituted with a charge transporting layer 3 and a charge generating layer 2.

The electrophotographic photoreceptor 7C shown in FIG. 3 includes a charge generating material and a charge transporting material in the same layer (single-layer type photosensitive layer 6). In the electrophotographic photoreceptor 7C shown in FIG. 3 has a structure including an undercoat layer 1 provided on an electroconductive substrate 4, and having a single-layer type photosensitive layer 6 and a protective layer 5 in this order thereon.

Furthermore, in each of the electrophotographic photoreceptors 7A, 7B, and 7C shown in FIGS. 1, 2, and 3, a protective layer 5 is the outermost surface layer which is positioned farthest from the electroconductive substrate 4, and the outermost surface layer is configured as described in the above.

In addition, in each of the electrophotographic photoreceptors shown in FIGS. 1, 2, and 3, an undercoat layer 1 may or may not be formed.

Hereinbelow, based on the electrophotographic photoreceptor 7A shown in FIG. 1 as a representative example, each of the elements will be described.

Protective Layer

The protective layer 5 (outermost surface layer) is the outermost surface layer of the electrophotographic photoreceptor 7A and is configured by a cured product of a composition which contains the specific position isomer mixture and at least one kind among the non-reactive charge transporting materials. That is, the protective layer 5 contains a cross-linked product of the specific position isomer mixture and at least one kind among the non-reactive charge transporting materials.

In addition, the protective layer 5 may contain other additives in addition to the above materials.

Moreover, as a curing method (polymerization/crosslinking method), radical polymerization by heat, light, radiation, or the like is carried out. Since unevenness of the film and occurrence of wrinkles are suppressed by adjusting the reaction not to proceed too quickly, it is preferable to carry out polymerization under the conditions in which generation of radicals occurs relatively slowly. From this viewpoint, thermal polymerization in which the polymerization rate is easily adjusted is suitable.

Specific Position Isomer Mixture

The specific position isomer mixture is a mixture of position isomers of at least one kind of the non-charge transporting compounds represented by the following Formulae (I) and (II).

That is, a mixture of position isomers of the at least one kind selected from the compounds represented by the following Formulae (I) and (II) is used as the specific position isomer mixture.

In addition, the specific position isomer mixture is a reactive compound.

Here, the specific position isomer mixture means a mixture which contains two or more kinds of specific non-charge transporting compounds in a relationship in which substituted positions of vinyl groups substituted with benzene rings of styryl groups are different.

Specifically, the substituted positions of vinyl groups substituted with benzene rings of styryl groups mean the ortho position, the meta position, and the para position.

It is confirmed that the specific position isomer mixture is mixture of the compounds in a relationship of position isomer by observing protons of the vinyl group by using NMR (apparatus name: UNITY-300 manufactured by Varian, Inc.), for example.

Hereinafter, a detailed description will be given of the specific position isomer mixture.

(I)

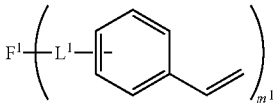

In the formula (I), $F^1$ represents an $m^1$-valent organic group having an aromatic ring, which does not have a charge transporting property. $L^1$ represents a divalent linking group containing at least one selected from —C(=O)—O— and —O—. $m^1$ represents an integer of 3 or more.

(II)

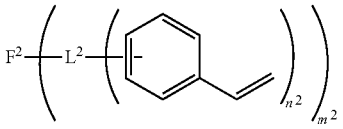

In the formula (II), $F^2$ represents an $m^2$-valent organic group having an aromatic ring, which does not have a charge transporting property. $L^2$ represents an $(n^2+1)$-valent linking group containing at least one selected from —C(=O)—O— and —O—. $m^2$ represents an integer of 2 or more. $n^2$ represents an integer of 2 to 3.

Here, "not having a charge transporting property" (that is, "being non-charge transporting property") means not exhibiting apparent photoinduced discharge characteristics.

Specifically, $F^1$ and $F^2$ represent a group containing no nitrogen atom. That is, is preferably an $m^1$-valent organic group having no nitrogen atom and having an aromatic ring, and $F^2$ is an $m^2$-valent organic group having no nitrogen atom and having an aromatic ring.

Specific examples of the group represented by $F^1$ and $F^2$ include those of the following structural formulae (1) to (9).

However, the group represented by $F^1$ or $F^2$ is an $m^1$-valent or $m^2$-valent group formed by the removal of a hydrogen atom from the aromatic ring among the groups represented by the structural formulae (1) to (9), depending on the valency.

(1)

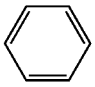

(2)

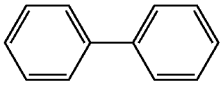

(3)

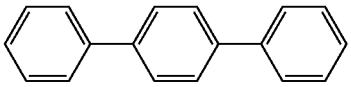

(4)

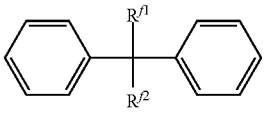

(5)

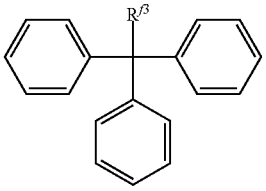

(6)

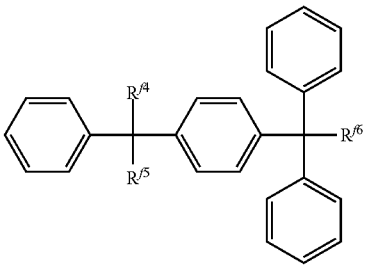

(7)

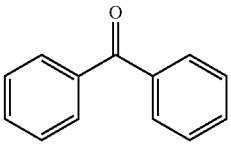

(8)

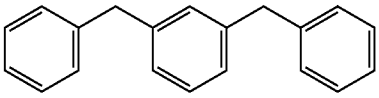

-continued (9)

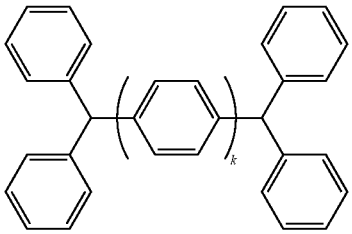

In the structural formulae (1) to (9), $R^{f1}$, $R^{f2}$, $R^{f3}$, $R^{f4}$, $R^{f5}$, and $R^{f6}$ each independently represent a hydrogen atom, or an alkyl group having 1 to 10 carbon atoms (preferably 1 to 7 carbon atoms), a cycloalkylene group, a substituted or unsubstituted phenyl group.

Furthermore, in the structural formulae (1) to (9), k represents an integer of from 0 to 3 (preferably from 0 to 2).

The aromatic ring in the structural formulae (1) to (9) may have a substituent, respectively.

Examples of the substituent which may be contained in the aromatic ring in the structural formulae (1) to (9) include an alkyl group having 1 to 6 carbon atoms, an alkoxy group having 1 to 6 carbon atoms, and a halogen group.

In the formula (I), $L^1$ represents a divalent linking group containing at least one selected from —C(═O)—O— and —O—.

Specifically, for example, $L^1$ represents a divalent linking group containing an alkylene group and at least one selected from —C(═O)—O—, and —O—.

Examples of the divalent linking group represented by $L^1$ include:

a divalent linking group in which —C(═O)—O— is interposed in the alkylene group, and a divalent linking group in which —O— is interposed in the alkylene group.

In addition, the linking group represented by $L^1$ may have two groups of —C(═O)—O— or —O— in the alkylene group.

Specific examples of the linking group represented by L' in the formula (I) include:

*—$(CH_2)_r$—C(═O)—O—$(CH_2)_s$—,

*—$(CH_2)_r$—O—C(═O)—$(CH_2)_t$—C(═O)—O—$(CH_2)_s$—,

*—$(CH_2)_r$—O—$(CH_2)_s$—, and

*—$(CH_2)_r$—O—$(CH_2)_t$—O—$(CH_2)_s$—.

Here, in the linking group represented by $L^1$, r represents an integer of 0 or 1 to 6 (preferably 1 to 5). s represents an integer of 1 to 6 (preferably 1 to 5). t represents an integer of 1 to 6 (preferably 1 to 5).

Further, in the linking group represented by $L^1$, "*" represents a site linked to $F^1$.

As a group linked to $F^1$ of the compound represented by the formula (I), more specifically, a group represented by the following formula (III) or (IV) is preferable.

(III)

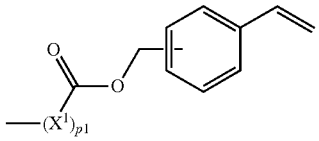

(IV)

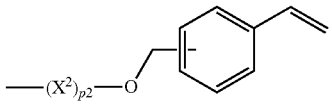

$X^1$ and $X^2$ each independently represent a divalent linking group, and p1 and p2 each independently represent 0 or 1.

In the formula (III) or (IV), $X^1$ represents a divalent linking group. p1 represents an integer of 0 or 1. $X^2$ represents a divalent linking group. p2 represents an integer of 0 or 1.

Here, examples of the divalent linking group represented by $X^1$ and $X^2$ include —$(CH_2)_{p3}$— (provided that p3 represents an integer of 1 to 6 (preferably 1 to 5)). Examples of the divalent linking group include an alkyloxy group.

p1 and p2 are preferably 1.

On the other hand, in the formula (II), $L^2$ represents an $(n^2+1)$-valent linking group containing at least one selected from —C(═O)—O— and —O—. $m^2$ represents an integer of 2 or more. $n^2$ represents an integer of 2 to 3.

$L^2$ specifically represents, for example, a trivalent or tetravalent group derived from an alkane, and an $(n^2+1)$-valent linking group having at least one selected from —C(═O)—O— and —O—.

In the formula (II), examples of the linking group represented by $L^2$ include:

an $(n^2+1)$-valent linking group in which —C(═O)—O— is interposed in an alkylene group linked in the branched shape, and an $(n^2+1)$-valent linking group in which —O— is interposed in an alkylene group linked in the branched shape.

In addition, the linking group represented by $L^2$ may have two groups of —C(═O)—O— or —O— in the alkylene group linked in the branched shape.

Specific examples of the linking group represented by $L^2$ in the formula (II) include:

*—$(CH_2)_r$—CH[C(═O)—O—$(CH_2)_s$—]$_2$,

*—$(CH_2)_r$—CH[$(CH_2)_t$—O—$(CH_2)_s$—]$_2$,

*—$(CH_2)_r$—O—$(CH_2)_u$—CH(—O—$(CH_2)_s$—)—$(CH_2)_t$—O—$(CH_2)_s$—

*—$(CH_2)_r$—O—C[$(CH_2)_t$—O—$(CH_2)_s$—]$_3$, and

*—$(CH_2)_r$—C(═O)—O—C[$(CH_2)_t$—O—$(CH_2)_s$—]$_3$.

Here, in the linking group represented by $L^2$, represents an integer of 0 or 1 to 6 (preferably 1 to 5). s represents an integer of 1 to 6 (preferably 1 to 5). t represents an integer of 1 to 6 (preferably 1 to 5). u represents an integer of 1 to 6 (preferably 1 to 5).

Further, in the linking group represented by $L^2$, "*" represents a site linked to $F^2$.

Among these, in the formula (II), preferable examples of the linking group represented by $L^2$ include:

*—$(CH_2)_r$—CH[C(═O)—O—$(CH_2)_s$—]$_2$, and

*—$(CH_2)_r$—CH[$(CH_2)_t$—O—$(CH_2)_s$—]$_2$.

As a group linked to $F^2$ of the compound represented by the formula (II), more specifically, a group represented by the following formula (V) or (VI) is preferable.

(V)

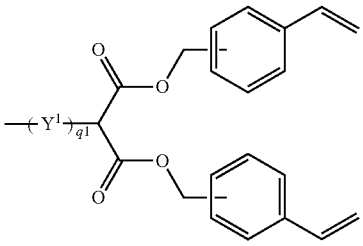

(VI)

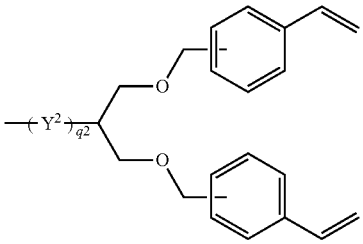

$Y^1$ and $Y^2$ each independently represent a divalent linking group, and q1 and q2 each independently represent 0 or 1.

In the formula (V) or (VI), $Y^1$ represents a divalent linking group. q1 represents an integer of 0 or 1. $Y^2$ represents a divalent linking group. q2 represents an integer of 0 or 1.

Here, examples of the divalent linking group represented by $Y^1$ and $Y^2$ include $—(CH_2)_{q3}—$ (provided that q3 represents an integer of 1 to 6 (preferably 1 to 5)). Examples of the divalent linking group include an alkyloxy group.

q1 and q2 are preferably 1.

In the formula (I), $m^1$ preferably represents an integer of 3 to 6, and more preferably 3 to 5.

In the formula (II), $m^2$ preferably represents an integer of 2 to 4, and more preferably 2 to 3.

Furthermore, $n^2$ is preferably 2.

Although structures of specific compounds as specific position isomer mixture will be shown below as Exemplary compounds, the specific position isomer mixture is not limited thereto. In addition, these structures may be used alone or may be blended with other specific position isomer mixtures.

| Number of Exemplary compound | |
|---|---|
| Exemplary compound 1 | 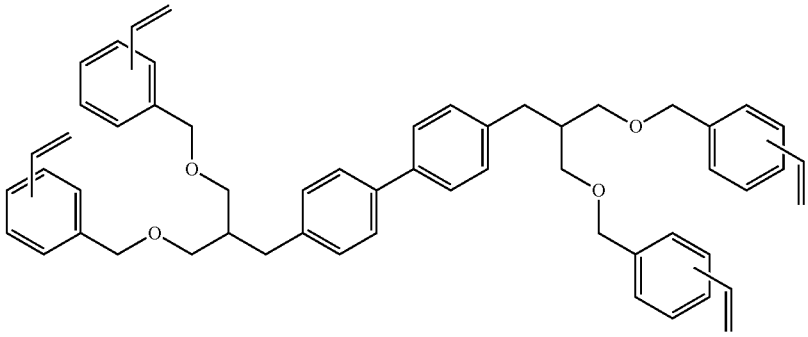 |
| Exemplary compound 2 | 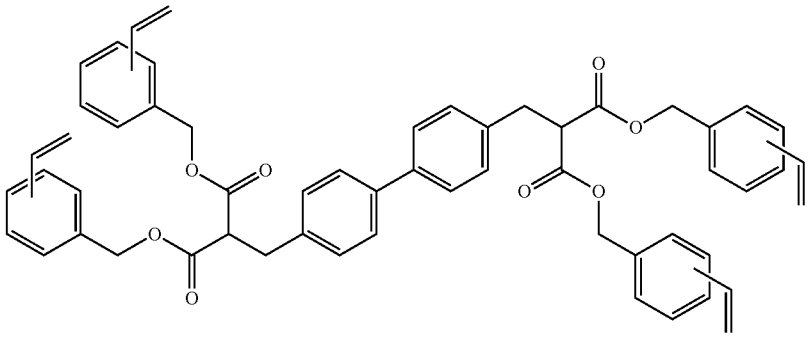 |

-continued
| Number of Exemplary compound | |
|---|---|
| Exemplary compound 3 | 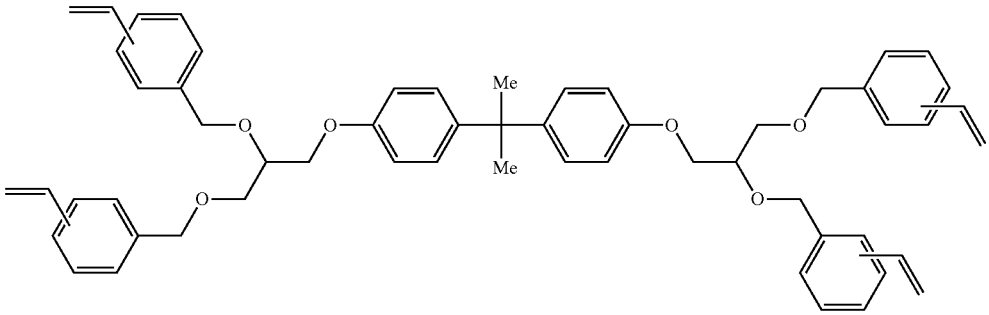 |
| Exemplary compound 4 | 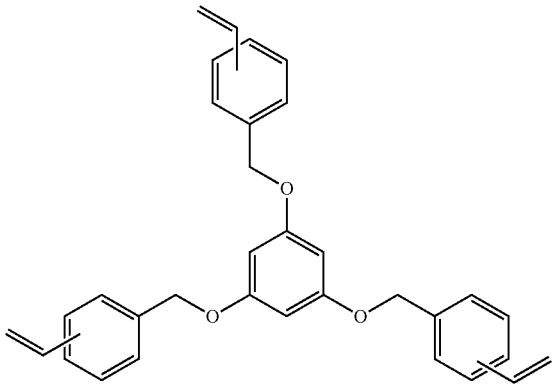 |
| Exemplary compound 5 | 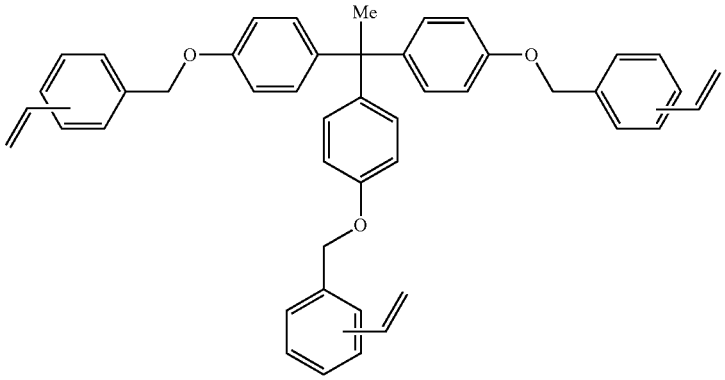 |

-continued
| Number of Exemplary compound | |
|---|---|
| Exemplary compound 6 | 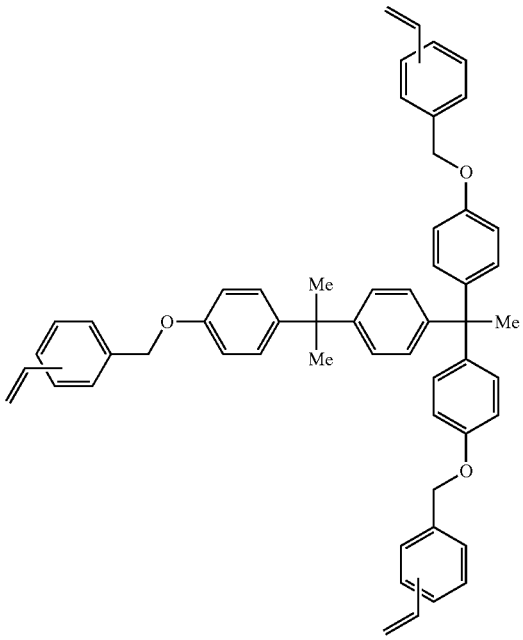 |
| Exemplary compound 7 | 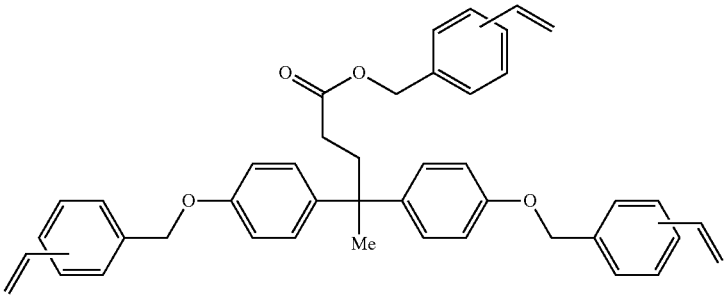 |
| Exemplary compound 8 | 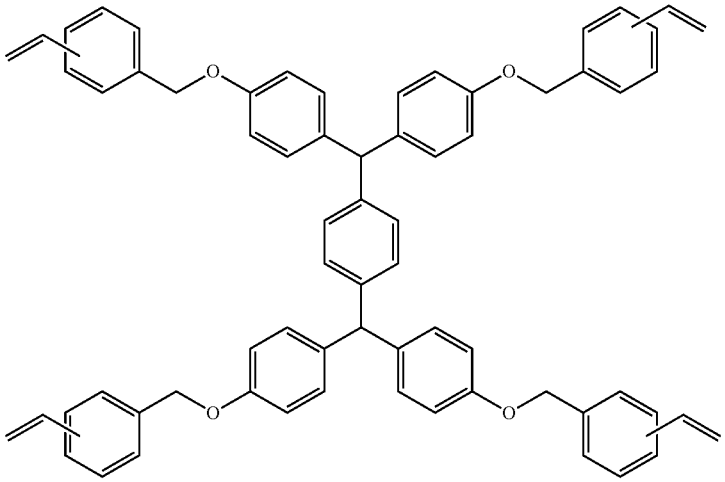 |

-continued
| Number of Exemplary compound | |
|---|---|
| Exemplary compound 9 | 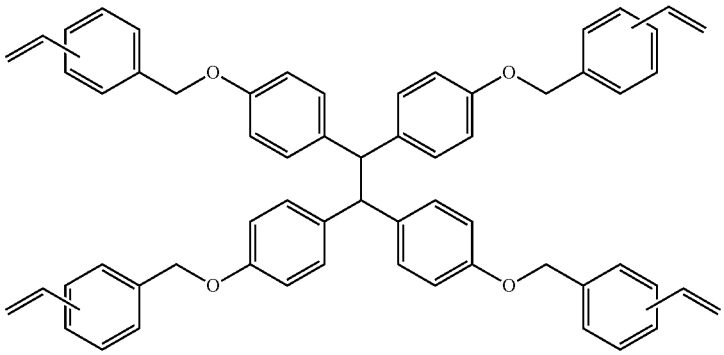 |
| Exemplary compound 10 | 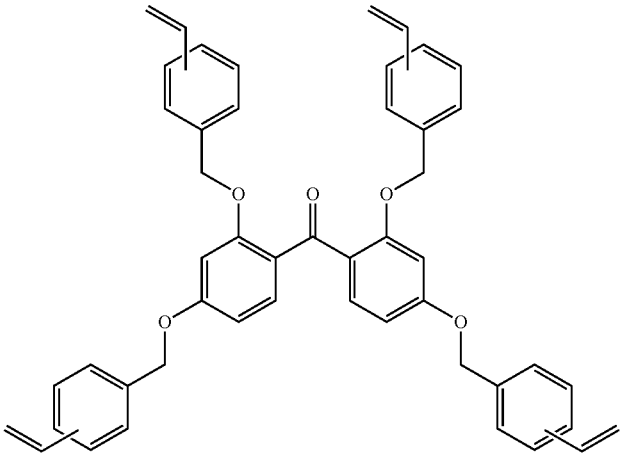 |
| Exemplary compound 11 | 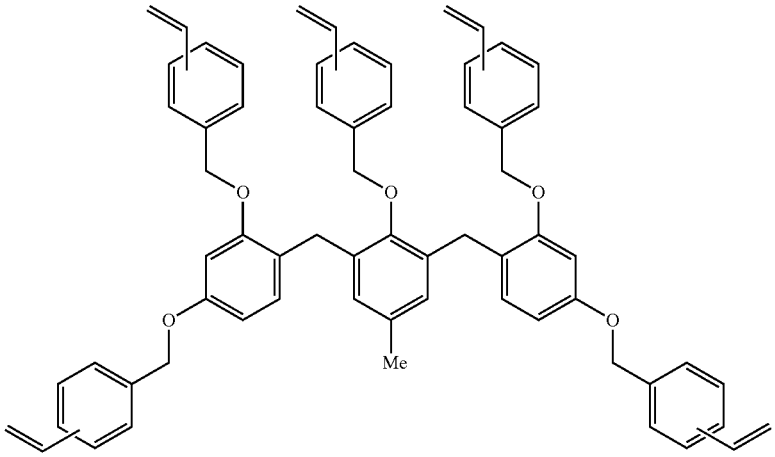 |

-continued
| Number of Exemplary compound | |
|---|---|
| Exemplary compound 12 | 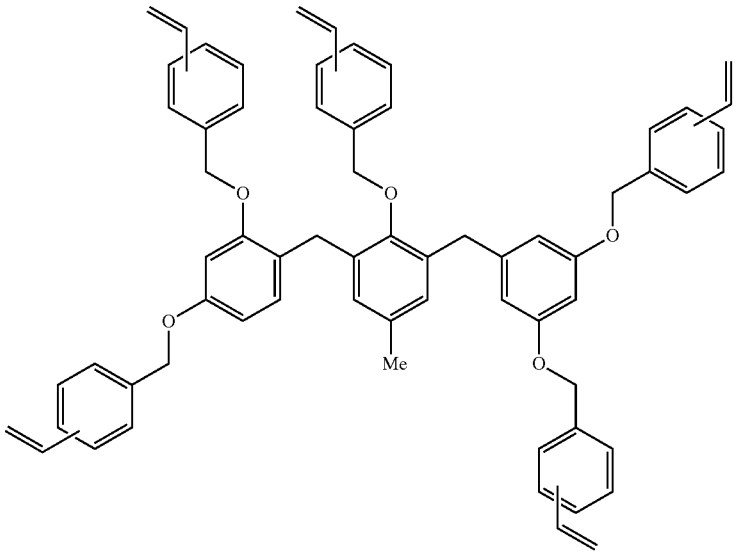 |
| Exemplary compound 13 | 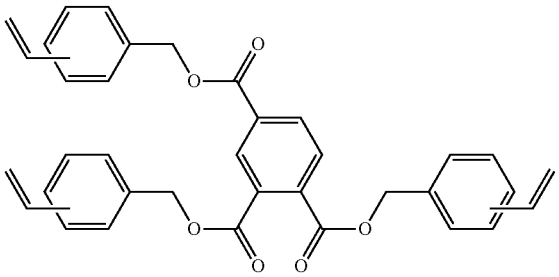 |
| Exemplary compound 14 | 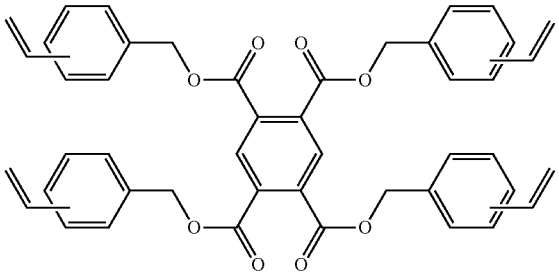 |
| Exemplary compound 15 | 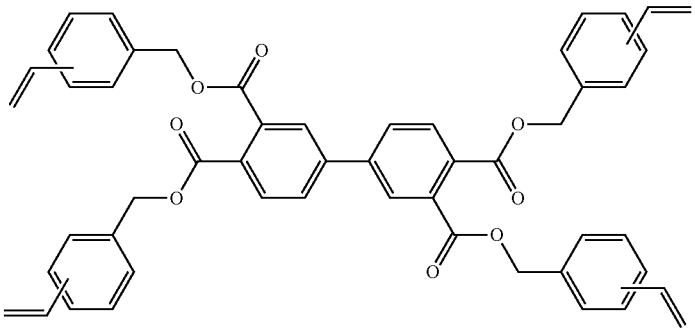 |

-continued

| Number of Exemplary compound | |
|---|---|
| Exemplary compound 16 | 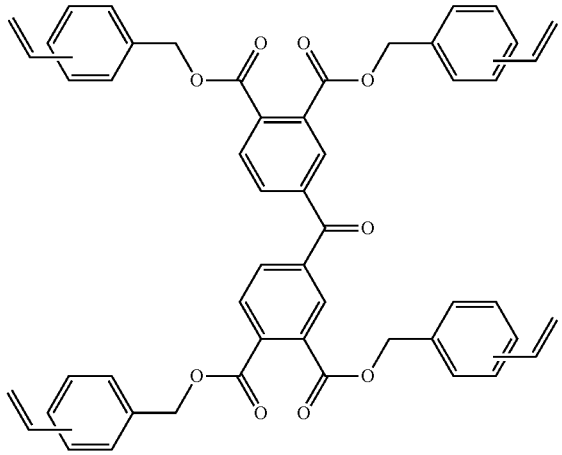 |
| Exemplary compound 17 | 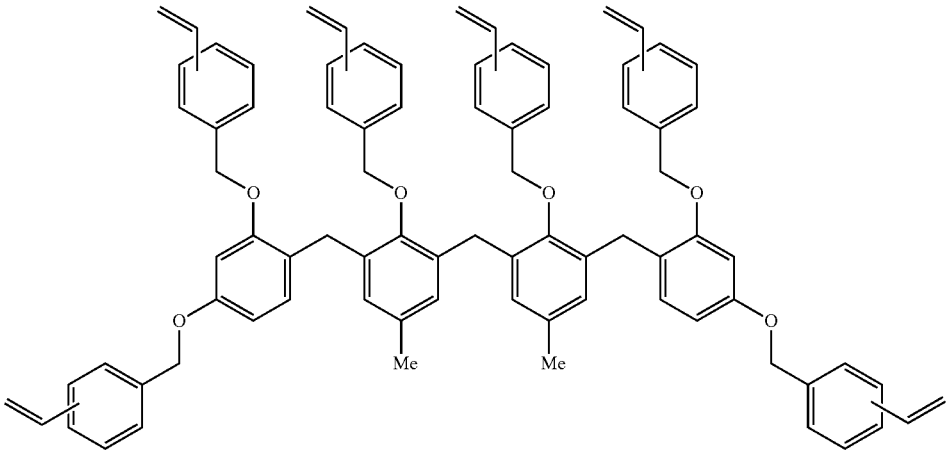 |

As the specific position isomer mixture, among the Exemplary compounds, 4, 5, 10, 11, and 16 are preferable, and 4, 5, and 11 are more preferable.

The specific position isomer mixture is synthesized as follows.

That is, the position isomer of the compound represented by Formula (I) or (II) is synthesized by performing esterification, etherification, or the like of carboxylic acid or alcohol, which is a precursor, with corresponding chloromethylstyrene or the like.

Here, examples of the method for synthesizing the specific position isomer mixture include a method of adding a mixture containing two or more kinds of compounds with styryl groups in a relationship of position isomer, in which positions of vinyl groups with respect to benzene rings are different, when the styryl groups are provided by esterification or etherification of a precursor.

Specifically, in a case of a synthesis scheme described below, for example, there is a method of adding a mixture of two or more kinds of chloromethylstyrene, in which vinyl groups are substituted at different positions with respect to benzene rings (specifically, mixture of chloromethylstyrene in which the vinyl group is substituted at the ortho position, chloromethylstyrene in which the vinyl group is substituted at the meta position, and chloromethylstyrene in which the vinyl group is substituted at the pare position, or a mixture of chloromethylstyrene in which the vinyl group is substituted at the meta position and coloromethylstyrene in which the vinyl group is substituted at the para position), when the styryl groups are provided.

The mixture of the position isomer compound added may be a mixture of the above three isomer compounds or may be a mixture of any two kinds of isomer compounds.

Although a method for synthesizing Compound 5 used in the exemplary embodiment will be shown below as an example, the compound is synthesized by a method reported in Helvetica Chimica Acta, 2002, vol. 85, #1, p. 352-387.

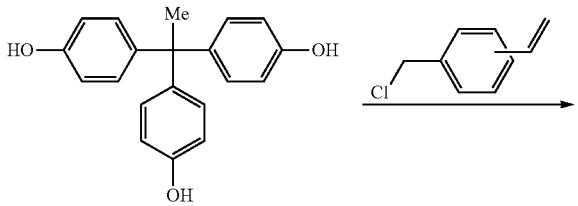

-continued

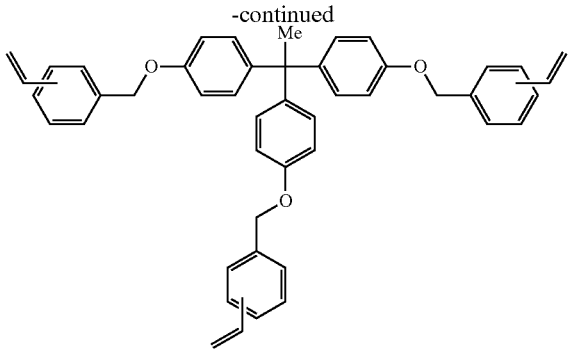

For example, in the case of introducing a reactive group with an ether bond, a method in which a corresponding alcohol and halogenated methylstyrene are condensed using a base such as pyridine, piperidine, triethylamine, dimethylaminopyridine, trimethylamine, DBU, sodium hydride, sodium hydroxide, potassium hydroxide, sodium carbonate, and potassium carbonate may be used. The halogenated methylstyrene may be added in an amount of 1 equivalent or more, preferably 1.2 equivalents or more, and more preferably 1.5 equivalents or more, based on the corresponding —OH groups, and the base may be added in an amount of 0.8 equivalent to 3.0 equivalents, and preferably from 1.0 equivalent to 2.0 equivalents, based on the halogenated methylstyrene. As the solvent, an aprotic polar solvent such as N-methylpyrrolidone, dimethylsulfoxide, and N,N-dimethylformamide; a ketone solvent such as acetone and methyl ethyl ketone; an ether solvent such as diethyl ether and tetrahydrofuran; an aromatic solvent such as toluene, chlorobenzene, and 1-chloronaphthalene; and the like are effective, and the solvent may be used in an amount in the range of 1 part by weight to 100 parts by weight, and preferably from 2 parts by weight to 50 parts by weight, based on 1 part by weight of the alcohol. The reaction temperature is determined according to the purposes. After completion of the reaction, the reaction liquid is poured into water, extracted with a solvent such as toluene, hexane, and ethyl acetate, washed with water, and may be purified using an adsorbent such as activated carbon, silica gel, porous alumina, and activated white clay, as desired.

Furthermore, in the case of introducing a reactive group with an ester bond, ordinary esterification in which a carboxylic acid and hydroxymethylstyrene are dehydrated and condensed using an acid catalyst, or a method in which a carboxylic acid and halogenated methylstyrene are condensed using a base such as pyridine, piperidine, triethylamine, dimethylaminopyridine, trimethylamine, DBU, sodium hydride, sodium hydroxide, potassium hydroxide, sodium carbonate, and potassium carbonate may be used, but the method using halogenated methylstyrene is preferable since it suppresses by-products. The halogenated methylstyrene may be added in an amount of 1 equivalent or more, preferably 1.2 equivalents or more, and more preferably 1.5 equivalents or more, based on the corresponding —COOH groups, and the base may be added in an amount of 0.8 equivalent to 3.0 equivalents, and preferably from 1.0 equivalent to 2.0 equivalents, based on the halogenated methylstyrene. As the solvent, an aprotic polar solvent such as N-methylpyrrolidone, dimethylsulfoxide, and N,N-dimethylformamide; a ketone solvent such as acetone and methyl ethyl ketone; an ether solvent such as diethyl ether and tetrahydrofuran; an aromatic solvent such as toluene, chlorobenzene, and 1-chloronaphthalene; and the like are effective, and the solvent may be used in an amount in the range of 1 part by weight to 100 parts by weight, and preferably from 2 parts by weight to 50 parts by weight, based on 1 part by weight of the carboxylic acid. The reaction temperature is determined according to the purposes. After completion of the reaction, the reaction liquid is poured into water, extracted with a solvent such as toluene, hexane, and ethyl acetate, washed with water, and may be purified using an adsorbent such as activated carbon, silica gel, porous alumina, and activated white clay, as desired.

The content of the specific non-reactive charge transporting material is preferably from 20% by weight to 60% by weight, and more preferably from 25% by weight to 50% by weight, based on the total solid content of the coating liquid for forming a protective layer 5 (outermost surface layer).

Non-Reactive Charge Transporting Material

The non-reactive charge transporting material is a charge transporting material having no chain polymerizable functional group.

As the non-reactive charge transporting material, a known charge transporting material may be used, and specific examples thereof include electron transporting compounds including quinone compounds such as p-benzoquinone, chloranil, bromanil, and anthraquinone; tetracyanoquinodimethane compounds; fluorenone compounds such as 2,4,7-trinitrofluorenone, xanthone compounds, benzophenone compounds, cyanovinyl compounds, and ethylene compounds; and hole transporting compounds including triarylamine compounds, benzidine compounds, arylalkane compounds, aryl-substituted ethylene compounds, stilbene compounds, anthracene compounds, and hydrazone compounds.

These charge transporting materials may be used singly or in combination of two or more kinds thereof, but the invention is not limited thereto.

These non-reactive charge materials preferably have an aromatic ring, whereby the electrical characteristics and the abrasion resistance of the protective layer 5 (outermost surface layer) are easily improved.

Among these, from the viewpoint of the electrical characteristics and the abrasion resistance of the protective layer 5 (outermost surface layer), a triarylamine derivative represented by the structural formula (a-1), a benzidine derivative represented by the structural formula (a-2), and a stilbene compound represented by structural formula (a-3) are preferable.

(a-1)

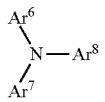

In the structural formula (a-1), $Ar^6$, $Ar^7$, and $Ar^8$ each independently represent a substituted or unsubstituted aryl group, $—C_6H_4—C(R^{10})=C(R^{11})(R^{12})$, or $—C_6H_4—CH=CH—CH=C(R^{13})(R^{14})$. $R^{10}$, $R^{11}$, $R^{12}$, $R^{13}$, and $R^{14}$ each independently represent a hydrogen atom, a substituted or unsubstituted alkyl group, or a substituted or unsubstituted aryl group.

Here, examples of the substituent of the respective groups include a halogen atom, an alkyl group having 1 to 5 carbon atoms, an alkoxy group having 1 to 5 carbon atoms, or a substituted amino group substituted with an alkyl group having 1 to 3 carbon atoms.

(a-2)

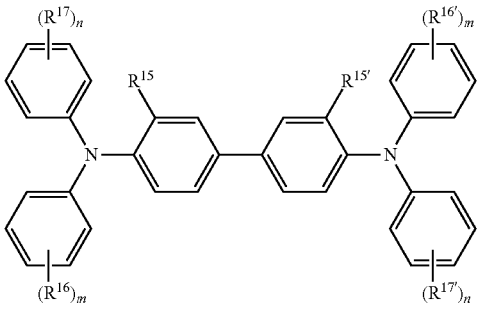

In the structural formula (a-2), $R^{15}$ and $R^{15'}$ each independently represent a hydrogen atom, a halogen atom, an alkyl group having 1 to 5 carbon atoms, or an alkoxy group having 1 to 5 carbon atoms. $R^{16}$, $R^{16'}$, $R^{17}$, and $R^{17'}$ each independently represent a halogen atom, an alkyl group having 1 to 5 carbon atoms, an alkoxy group having 1 to 5 carbon atoms, an amino group substituted with an alkyl group having 1 to 2 carbon atoms, a substituted or unsubstituted aryl group, —C($R^{18}$)═C($R^{19}$)($R^{20}$), or —CH═CH—CH═C($R^{21}$)($R^{22}$), and $R^{18}$, $R^{19}$, $R^{20}$, $R^{21}$ and $R^{22}$ each independently represent a hydrogen atom, a substituted or unsubstituted alkyl group, or a substituted or unsubstituted aryl group. m and n each independently represent an integer of 0 to 2.

Here, examples of the substituent of the respective groups include a halogen atom, an alkyl group having 1 to 5 carbon atoms, an alkoxy group having 1 to 5 carbon atoms, or a substituted amino group substituted with an alkyl group having 1 to 3 carbon atoms.

(a-3)

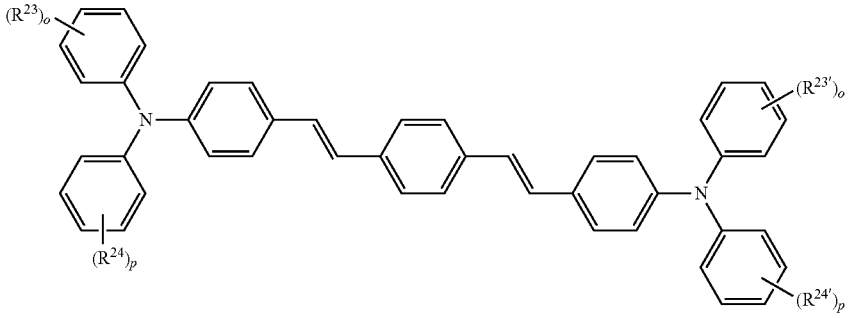

In the structural formula (a-3), $R^{23}$ and $R^{23'}$ each independently represent a halogen atom, an alkyl group having 1 to 5 carbon atoms, an alkoxy group having 1 to 5 carbon atoms, an amino group substituted with an alkyl group having 1 to 2 carbon atoms, or a substituted or unsubstituted aryl group. $R^{24}$ and $R^{24'}$ each independently represent a halogen atom, an alkyl group having 1 to 5 carbon atoms, an alkoxy group having 1 to 5 carbon atoms, an amino group substituted with an alkyl group having 1 to carbon atoms, or a substituted or unsubstituted aryl group. o and p each independently represent an integer of 0 to 2.

Here, examples of the substituent of the respective groups include a halogen atom, an alkyl group having 1 to 5 carbon atoms, an alkoxy group having 1 to 5 carbon atoms, or a substituted amino group substituted with an alkyl group having 1 to 3 carbon atoms.

Here, among the triarylamine derivatives each represented by the structural formula (a-1) and the benzidine derivatives each represented by the structural formula (a-2), triarylamine derivatives each having "—$C_6H_4$—CH═CH—CH═C($R^{13}$)($R^{14}$)" and benzidine derivatives each having "—CH═CH—CH═C($R^{21}$)($R^{22}$)" are preferable since they are excellent from the viewpoints that they are excellent in charge mobility, adhesiveness to a lower layer in contact with the protective layer 5 (outermost surface layer), resistance to the residual image that occurs owing to the remaining hysteresis of a previous images (hereinafter also referred to as a "ghost"), and others.

Resin Particles

The electrophotographic photoreceptor according to the present exemplary embodiment includes resin particles in the outermost surface layer. The reason therefor is not clear, but it is contemplated that if the electrophotographic photoreceptor includes the resin particles in the outermost surface layer, the coefficient of friction with a member in contact with the electrophotographic photoreceptor decreases, and therefore, an electrophotographic photoreceptor having suppressed abrasion of the outermost surface layer is obtained.

It is also contemplated that if the electrophotographic photoreceptor includes the resin particles in the outermost surface layer, both of the electrical characteristics and the abrasion resistance are easily increased. Particularly, if the electrophotographic photoreceptor includes the resin particles (particularly fluorine resin particles) in the outermost surface layer, the surface smoothness, abrasion resistance, and detachability of the toner on the electrophotographic photoreceptor are improved.

Examples of the resin particles include fluorine resin particles.

As the resin particles, fluorine resin particles are preferable, and among those, at least one selected from an ethylene tetrafluoride resin (PTFE), an ethylene trifluorochloride resin, a propylene hexafluoride resin, a vinyl fluoride resin, a vinylidene fluoride resin, an ethylene dichlorodifluoride resin, and a copolymer thereof is preferable. Further, among these fluorine resin particles, an ethylene tetrafluoride resin and a vinylidene fluoride resin are particularly preferable.

In addition, in order to disperse the resin particles in the coating liquid, various dispersants may be used in combination.

The average primary particle diameter of the resin particles is preferably from 0.05 μm to 1 μm, and more preferably from 0.1 μm to 0.5 μm.

The average particle diameter of the resin particles refers to a value measured using a laser diffraction type particle size distribution measurement device LA-700 (manufactured by Horiba, Ltd.).

The content of the resin particles is preferably from 0.1% by weight to 40% by weight, and more preferably from 1% by weight to 30% by weight, based on the weight of the protective layer 5 (outermost surface layer).

Other Additives

The film constituting the protective layer 5 (outermost surface layer) may use a compound having an unsaturated bond in combination.

The compound having an unsaturated bond may be any one of a monomer, an oligomer, and a polymer, and may further have a charge transporting skeleton.

Examples of the compound having an unsaturated bond, which has no charge transporting skeleton, include the following compounds.

Specifically, examples of the monofunctional monomers include isobutyl acrylate, t-butyl acrylate, isoctyl acrylate, lauryl acrylate, stearyl acrylate, isobornyl acrylate, cyclohexyl acrylate, 2-methoxyethyl acrylate, methoxytriethylene glycol acrylate, 2-ethoxyethyl acrylate, tetrahydrofurfuryl acrylate, benzyl acrylate, ethylcarbitol acrylate, phenoxyethyl acrylate, 2-hydroxyacrylate, 2-hydroxypropyl acrylate, 4-hydroxybutyl acrylate, methoxypolyethylene glycol acrylate, methoxypolyethylene glycol methacrylate, phenoxypolyethylene glycol acrylate, phenoxypolyethylene glycol methacrylate, hydroxyethyl-o-phenylphenol acrylate, o-phenylphenol glycidyl ether acrylate, and styrene.

Examples of the difunctional monomers include diethylene glycol di(meth)acrylate, polyethylene glycol di(meth) acrylate, polypropylene glycol di(meth)acrylate, neopentyl glycol di(meth)acrylate, 1,6-hexanediol di(meth)acrylate, divinylbenzene, and diallyl phthalate.

Examples of the trifunctional monomers include trimethylol propane tri(meth)acrylate, pentaerythritol tri(meth)acrylate, aliphatic tri(meth)acrylate, and trivinylcyclohexane.

Examples of the tetrafunctional monomers include pentaerythritol tetra(meth)acrylate, ditrimethylolpropane tetra (meth)acrylate, aliphatic tetra(meth)acrylate.

Examples of the pentafunctional or higher functional monomers include (meth)acrylates having a polyester skeleton, a urethane skeleton, and a phosphagen skeleton, in addition to dipentaerythritol penta(meth)acrylate, dipentaerythritol hexa (meth) acrylate.

Furthermore, examples of the reactive polymer include those disclosed in, for example, JP-A-5-216249, JP-A-5-323630, JP-A-11-52603, JP-A-2000-264961, and JP-A-2005-2291.

In the case where a compound which has an unsaturated bond, and has no charge transporting component, is used, it is used singly or as a mixture of two or more kinds thereof. In the case where a compound which has an unsaturated bond, and has no charge transporting component, is used to form the outermost surface layer of the electrophotographic photoreceptor, it is used in the amount of preferably 60% by weight or less, more preferably 55% by weight or less, and even more preferably 50% by weight or less, based on the total solid content of the composition used to form the protective layer 5 (outermost surface layer).

Meanwhile, examples of the compound having an unsaturated bond, which has a charge transporting skeleton, include the following compounds.

Compound Having Chain Polymerizable Functional Group (Chain Polymerizable Functional Group Other Than Styryl Group) and Charge Transporting Skeleton in the Same Molecule The chain polymerizable functional group in the compound having a chain polymerizable functional group and a charge transporting skeleton in the same molecule is not particularly limited as long as it is a functional group that is capable of radical polymerization, and it is, for example, a functional group having a group which contains at least carbon double bonds. Specific examples thereof include a group containing at least one selected from a vinyl group, a vinyl ether group, a vinyl thioether group, a styryl group, an acryloyl group, a methacryloyl group, and derivatives thereof. Among these, in terms of high reactivity, the chain polymerizable functional group is preferably a group containing at least one selected from a vinyl group, a styryl group, an acryloyl group, a methacryloyl group, and derivatives thereof.

Furthermore, the charge transporting skeleton in the compound having a chain polymerizable functional group and a charge transporting skeleton in the same molecule is not particularly limited as long as it has a structure known in electrophotographic photoreceptor, and it is, for example, a skeleton derived from a nitrogen-containing hole transporting compound such as a triarylamine compound, a benzidine compound, and a hydrazone compound, of which structures have conjugation with nitrogen atoms. Among these, a triarylamine skeleton is preferable.

The compound having the chain polymerizable functional group and the charge transporting skeleton in the same molecule may be the polymer described in the paragraphs [0132] to [0155] of JP-A-2012-159521.

The film constituting the protective layer 5 (outermost surface layer) may be used in a mixture with other coupling agents, particularly, fluorine-containing coupling agents for the purpose of further adjusting film formability, flexibility, lubricating property, and adhesiveness. As these compounds, various silane coupling agents and commercially available silicone hard coat agents are used. In addition, a radically polymerizable group-containing silicon compound or a fluorine-containing compound may be used.

Examples of the silane coupling agent include vinyltrichlorosilane, vinyltrimethoxysilane, vinyltriethoxysilane, 3-glycidoxypropylmethyldiethoxysilane, 3-glycidoxypropyltriethoxysilane, 3-glycidoxypropyltrimethoxysilane, 3-aminopropyltriethoxysilane, 3-aminopropyltrimethoxysilane, 3-aminopropylmethyldimethoxysilane, N-2(aminoethyl)-3-aminopropyltriethoxysilane, tetramethoxysilane, methyltrimethoxysilane, and dimethyldimethoxysilane.

Examples of the commercially available hard coat agent include KP-85, X-40-9740, and X-8239 (all manufactured by Shin-Etsu Chemical Co., Ltd.), and AY42-440, AY42-441, and AY-49-208 (all manufactured by Dow Corning Toray Co., Ltd.).

In addition, in order to impart water repellency, a fluorine-containing compound such as (tridecafluoro-1,1,2,2-tetrahydrooctyl)triethoxysilane, (3,3,3-trifluoropropyl)trimethoxysilane, 3-(heptafluoroisopropoxy)propyltriethoxysilane, 1H,1H,2H,2H-perfluoroalkyltriethoxysilane, 1H,1H,2H,2H-perfluorodecyltriethoxysilane, and 1H,1H,2H,2H-perfluorooctyltriethoxysilane may be added.

The silane coupling agent may be used in an arbitrary amount, but the amount of the fluorine-containing compound is preferably 0.25 time or less by weight, based on the compound containing no fluorine from the viewpoint of the film formability of the crosslinked film. In addition, a reactive fluorine compound disclosed in JP-A-2001-166510 or the like may be mixed.

Examples of the silicon-containing compound and fluorine-containing compound which have radically polymerizable group include the compounds described in JP-A-2007-11005.

A deterioration inhibitor is preferably added to the film constituting the protective layer 5 (outermost surface layer). Preferable examples of the deterioration inhibitor include hindered phenol deterioration inhibitors and hindered amine deterioration inhibitors, and known antioxidants such as organic sulfur antioxidants, phosphite antioxidants, dithiocarbamate antioxidants, thiourea antioxidants, and benzimidazole antioxidants may be used.

The amount of the deterioration inhibitor to be added is preferably 20% by weight or less, and more preferably 10% by weight or less.

Examples of the hindered phenol antioxidant include Irganox 1076, Irganox 1010, Irganox 1098, Irganox 245, Irganox 1330, and Irganox 3114 (all manufactured by BASF), and 3,5-di-t-butyl-4-hydroxybiphenyl.

Examples of the hindered amine antioxidants include SANOL LS2626, SANOL LS765, SANOL LS770, and SANOL LS744 (all manufactured by Sankyo Lifetech Co., Ltd.), TINUVIN 144 and TINUVIN 622LD (both manufactured by BASF), and MARK LA57, MARK LA67, MARK LA62, MARK LA68, and MARK LA63 (all manufactured by Adeka Corporation); examples of the thioether antioxidants include SUMILIZER TPS and SUMILIZER TP-D (all manufactured by Sumitomo Chemical Co., Ltd.); and examples of the phosphite antioxidants include MARK 2112, MARK PEP-8, MARK PEP-24G, MARK PEP-36, MARK 329K, and MARK HP-10 (all manufactured by Adeka Corporation).

Electroconductive particles, organic particles, or inorganic particles other than the resin particles may be added to the film constituting the protective layer 5 (outermost surface layer).

By way of an example of the particles, silicon-containing particles may be mentioned. The silicon-containing particles are particles containing silicon as a constituent element. Specific examples thereof include colloidal silica and silicone particles. The colloidal silica used as the silicon-containing particles is selected from silica having an average particle diameter of 1 nm to 100 nm, and preferably from 10 nm to 30 nm, which is dispersed in an acidic or alkaline aqueous dispersion or in an organic solvent such as an alcohol, a ketone, and an ester. As the particles, commercially available ones may be used.

The solid content of the colloidal silica in the protective layer 5 (outermost surface layer) is not particularly limited, but it is used in an amount in the range of 0.1% by weight to 50% by weight, and preferably from 0.1% by weight to 30% by weight, based on the total solid content of the protective layer 5.

The silicone particles used as the silicon-containing particles are selected from silicone resin particles, silicone rubber particles, and treated silica particles whose surfaces have been treated with silicone, and commercially available silicone particles may be used.

These silicone particles are spherical, and the average particle diameter is preferably from 1 nm to 500 nm, and more preferably from 10 nm to 100 nm.

The content of the silicone particles in the surface layer is preferably from 0.1% by weight to 30% by weight, and more preferably from 0.5% by weight to 10% by weight, based on the total amount of the total solid content of the protective layer 5 (outermost surface layer).

In addition, examples of other particles include particles including fluorine resins and resins formed by the copolymerization of monomers having hydroxyl groups, and semiconductive metal oxides such as $ZnO—Al_2O_3$, $SnO_2—Sb_2O_3$, $In_2O_3—SnO_2$, $ZnO_2—TiO_2$, $ZnO—TiO_2$, $MgO—Al_2O_3$, $FeO—TiO_2$, $TiO_2$, $SnO_2$, $In_2O_3$, ZnO, and MgO. Further, various known dispersant materials may be used to disperse the particles.

Oils such as a silicone oil may be added to the film constituting the protective layer 5 (outermost surface layer).

Examples of the silicone oil include silicone oils such as dimethylpolysiloxane, diphenylpolysiloxane, and phenylmethylsiloxane; reactive silicone oils such as amino-modified polysiloxane, epoxy-modified polysiloxane, carboxylic-modified polysiloxane, carbinol-modified polysiloxane, methacryl-modified polysiloxane, mercapto-modified polysiloxane, and phenol-modified polysiloxane; cyclic dimethylcyclosiloxanes such as hexamethylcyclotrisiloxane, octamethylcyclotetrasiloxane, decamethylcyclopentasiloxane, and dodecamethylcyclohexasiloxane; cyclic methylphenylcyclosiloxanes such as 1,3,5-trimethyl-1,3,5-triphenylcyclotrisiloxane, 1,3,5,7-tetramethyl-1,3,5,7-tetraphenylcyclotetrasiloxane, and 1,3,5,7,9-pentamethyl-1,3,5,7,9-pentaphenylcyclopentasiloxane; cyclic phenylcyclosiloxanes such as hexaphenylcyclotrisiloxane; fluorine-containing cyclosiloxanes such as 3-(3,3,3-trifluoropropyl)methylcyclotrisiloxane; hydrosilyl group-containing cyclosiloxanes such as a methylhydrosiloxane mixture, pentamethylcyclopentasiloxane, and phenylhydrocyclosiloxane; and vinyl group-containing cyclosiloxanes such as pentavinylpentamethylcyclopentasiloxane.

A metal, a metal oxide, carbon black, or the like may be added to the film constituting the protective layer (outermost surface layer). Examples of the metal include aluminum, zinc, copper, chromium, nickel, silver and stainless steel, and resin particles having any of these metals deposited on the surface thereof. Examples of the metal oxide include zinc oxide, titanium oxide, tin oxide, antimony oxide, indium oxide, bismuth oxide, indium oxide on which tin has been doped, tin oxide having antimony or tantalum doped thereon, and zirconium oxide having antimony doped thereon.

These may be used singly or in combination of two or more kinds thereof. When two or more kinds are used in combination, they may be simply mixed, or formed into a solid solution or a fusion. The average particle diameter of the electroconductive particles is 0.3 μm or less, and particularly preferably 0.1 μm or less.

Composition

The composition used to form the protective layer 5 (outermost surface layer) is preferably prepared as a coating liquid for forming a protective layer obtained by dissolving or dispersing the respective components in the solvent.

The coating liquid for forming a protective layer may be solvent-free, or may be prepared with, if necessary, a singular solvent or a mixed solvent of aromatic solvents such as toluene and xylene; ketone solvents s such as methyl ethyl ketone, methyl isobutyl ketone, and cyclohexanone; ester solvents such as ethyl acetate and butyl acetate; ether solvents such as tetrahydrofuran and dioxane; cellosolve solvents such as ethylene glycol monomethylether, and alcohol solvents such as isopropyl alcohol and butanol.

Furthermore, when the above-described components are reacted with each other to obtain a coating liquid for forming a protective layer, the respective components may be simply mixed and dissolved, but alternatively, the components may be preferably warmed under the conditions of a temperature of 0° C. to 100° C., and more preferably from 10° C. to 80° C., and a period of preferably from 10 minutes to 100 hours, and more preferably from 1 hour to 50 hours. Further, it is also preferable to irradiate ultrasonic waves. Thus, the uniformity of the coating liquid is increased, thereby obtaining a layer having a suppressed defect during coating.

Preparation of Protective Layer

The coating liquid for forming the protective layer 5 is coated on a surface to be coated (in the case of the exemplary embodiment shown in FIG. 1, the charge transporting layer 3), by an ordinary method such as a blade coating method, a wire bar coating method, a spray coating method, an extrusion coating method, a dip coating method, a bead coating method, an air knife coating method, a curtain coating method, and an ink jet coating method.

Thereafter, light, an electron beam, or heat is applied to the obtained film to induce radical polymerization, and thus, polymerize and cure the coating film.

For the curing method, heat, light, radiation, or the like is used. In the case where polymerization and curing are carried out using heat and light, a polymerization initiator is not necessarily required, but a photocuring catalyst or a thermal polymerization initiator may be used. As the photocuring catalyst and the thermal polymerization initiator, a known photocuring catalyst or thermal polymerization initiator is used. As the radiation, an electron beam is preferable.

Next, polymerization and curing of the protective layer 5 (outermost surface layer) will be described.

For the curing method, heat, light, radiation, or the like is used. In the case where polymerization and curing are carried out using heat and light, a polymerization initiator is not necessarily required, but a photocuring catalyst or a thermal polymerization initiator may be used. As the photocuring catalyst and the thermal polymerization initiator, a known photocuring catalyst or thermal polymerization initiator is used. As the radiation, an electron beam is preferable.

In addition, since in the electrophotographic photoreceptor according to the present exemplary embodiment, the specific non-charge transporting compound is trifunctional or higher functional, the outermost surface layer is preferably a layer cured by a reaction including at least a heating step.

In this regard, it is contemplated that since the molecular motion of a trifunctional or higher functional monomer tends to be easily frozen, as compared with a bifunctional monomer, in the case of a curing method by heating, the specific non-charge transporting compound and the charge transporting material tend to promote the heat motion in the crosslinking reaction, and therefore, the crosslinking density increases while maintaining the dispersion state of the molecules. As a result, it is contemplated that there is obtained a protective layer 5 in which the specific non-charge transporting compound forms a crosslinked structure and the structure includes a cured product including the charge transporting materials not unevenly distributed.

Furthermore, it is contemplated that a curing method by only heating makes the polymerization reaction to proceed uniformly, as compared with other methods.

Further, it is contemplated that since the irradiation side is easily reacted when curing is carried out by light or radiation, and thus, the polymerization reaction easily becomes non-uniform. As a result, it is preferable to initiate the polymerization by light or radiation, followed by heating, to facilitate the reaction to be more uniform.

Electron Beam Curing

In the case of using electron beam, the accelerating voltage is preferably 300 kV or less, and more preferably 150 kV or less. Further, the radiation dose is preferably in the range of 1 Mrad to 100 Mrad, and more preferably in the range of 3 Mrad to 50 Mrad. If the accelerating voltage is 300 kV or less, the damage of electron beam irradiation to the photoreceptor characteristics is suppressed. Further, if the radiation dose is 1 Mrad or more, the crosslinking is carried out, and thus, the radiation dose of 100 Mrad or less suppresses deterioration of the photoreceptor.

The irradiation is carried out in an inert gas atmosphere such as nitrogen and argon, at an oxygen concentration of 1000 ppm or less, and preferably 500 ppm or less, and furthermore, heating may be carried out during the irradiation or after the irradiation, at a temperature of 50° C. to 150° C.

Photocuring

As a light source, a high pressure mercury lamp, a low pressure mercury lamp, a metal halide lamp, or the like is used, and a suitable wavelength may be selected by using a filter such as a band-pass filter. The wavelength may be selected depending on the irradiation time and the light intensity, but, for example, the illumination (365 nm) is preferably from 300 mW/cm$^2$ to 1000 mW/cm$^2$, and for example, in the case of irradiating with UV light at 600 mW/cm$^2$, the duration of the irradiation may be from 5 seconds to 360 seconds.

Irradiation is carried out under an inert gas atmosphere of nitrogen and argon, at an oxygen concentration of 1000 ppm or less, and preferably 500 ppm or less, and heating may be carried out at 50° C. or higher and 150° C. or lower during irradiation or after irradiation.

As a photocuring catalyst, an intramolecular cleavage type photocuring catalyst, such as a benzyl ketal photocuring catalyst, an alkylphenone photocuring catalyst, an aminoalkylphenone photocuring catalyst, a phosphine oxide photocuring catalyst, a titanocene photocuring catalyst, and an oxime photocuring catalyst may be exemplified.

More specific example of the benzyl ketal photocuring catalyst include 2,2-dimethoxy-1,2-diphenylethan-1-one.

Furthermore, examples of the alkylphenone photocuring catalyst include 1-hydroxy-cyclohexyl-phenyl-ketone, 2-hydroxy-2-methyl-1-phenyl-propan-1-one, 1-[4-(2-hydroxyethoxy)-phenyl]-2-hydroxy-2-methyl-1-propan-1-one, 2-hydroxy-1-{4-[4-(2-hydroxy-2-methyl-propionyl)-benzyl] phenyl}-2-methyl-propan-1-one, acetophenone, and 2-phenyl-2-(p-toluenesulfonyloxy)acetophenone.

Examples of the aminoalkylphenone photocuring catalyst include p-dimethylaminoacetophenone, p-dimethylaminopropiophenone, 2-methyl-1-(4-methylthiophenyl)-2-morpholinopropan-1-one, and 2-benzyl-2-dimethylamino-1-(4-morpholinophenyl)-butanone-1,2-(dimethylamino)-2-[(4-methylphenyl)methyl]-1-[4-(4-morpholinyl)phenyl]-1-butanone.

Examples of the phosphine oxide photocuring catalyst include 2,4,6-trimethylbenzoyl-diphenyl phosphine oxide and bis(2,4,6-trimethylbenzoyl)phenyl phosphine oxide.

Examples of the titanocene photocuring catalyst include bis(η5-2,4-cyclopentadien-1-yl)-bis(2,6-difluoro-3-(1H-pyrrol-1-yl)-phenyl)titanium.

Examples of the oxime photocuring catalyst include 1,2-octanedione, 1-[4-(phenylthio)-, 2-(O-benzoyloxime)], ethanone, 1-[9-ethyl-6-(2-methylbenzoyl)-9H-carbazol-3-yl]-, 1-(O-acetyloxime).

Examples of the hydrogen drawing type photocuring catalyst include a benzophenone photocuring catalyst, a thioxanthone photocuring catalyst, a benzyl photocuring catalyst, and a Michler's ketone photocuring catalyst.

More specific examples of the benzophenone photocuring catalyst include 2-benzoyl benzoic acid, 2-chlorobenzophenone, 4,4'-dichlorobenzophenone, 4-benzoyl-4'-methyldiphenyl sulfide, and p,p'-bisdiethylaminobenzophenone.

Examples of the thioxanthone photocuring catalyst include 2,4-diethylthioxanthen-9-one, 2-chlorothioxanthone, and 2-isopropylthioxanthone.

Example of the benzyl photocuring catalyst include benzyl, (±)-camphor-quinone, and p-anisyl.

These photopolymerization initiators may be used singly or in combination of two or more kinds thereof.

Thermal Curing

Examples of the thermal polymerization initiator include thermal radical generators or derivatives thereof, specifically, for example, an azo initiator such as V-30, V-40, V-59, V601, V65, V-70, VF-096, VE-073, Vam-110, and Vam-111 (all manufactured by Wako Pure Chemicals Industries, Ltd.), and OTazo-15, OTazo-30, AIBN, AMBN, ADVN, and ACVA (all manufactured by Otsuka Chemical Co., Ltd.); and Pertetra A, Perhexa HC, Perhexa C, Perhexa V, Perhexa 22, Perhexa MC, Perbutyl H, Percumyl H, Percumyl P, Permenta H, Perocta H, Perbutyl C, Perbutyl D, Perhexyl D, Peroyl IB, Peroyl 355, Peroyl L, Peroyl SA, NYPER BW, NYPER-BMT-K40/M, Peroyl IPP, Peroyl NPP, Peroyl TCP, Peroyl OPP, Peroyl SBP, Percumyl ND, Perocta ND, Perhexyl ND, Perbutyl ND, Perbutyl NHP, Perhexyl PV, Perbutyl PV, Perhexa 250, Perocta O, Perhexyl O, Perbutyl O, Perbutyl L, Perbutyl 355, Perhexyl I, Perbutyl I, Perbutyl E, Perhexa 25Z, Perbutyl A, Perhexyl Z, Perbutyl ZT, and Perbutyl Z (all manufactured by NOF CORPORATION), Kayaketal AM-C55, Trigonox 36-C75, Laurox, Perkadox L-W75, Perkadox CH-50L, Trigonox TMBH, Kaya cumen H, Kaya butyl H-70, Perkadox BC-FF, Kaya hexa AD, Perkadox 14, Kaya butyl C, Kaya butyl D, Kaya hexa YD-E85, Perkadox 12-XL25, Perkadox 12-EB20, Trigonox 22-N70, Trigonox 22-70E, Trigonox D-T50, Trigonox 423-C70, Kaya ester CND-C70, Kaya ester CND-W50, Trigonox 23-C70, Trigonox 23-W50N, Trigonox 257-C70, Kaya ester P-70, Kaya ester TMPO-70, Trigonox 121, Kaya ester O, Kaya ester HTP-65W, Kaya ester AN, Trigonox 42, Trigonox F-050, Kaya butyl B, Kaya carbon EH-C70, Kaya carbon EH-W60, Kaya carbon 1-20, Kaya carbon BIC-75, Trigonox 117, and Kayaren 6-70 (all manufactured by Kayaku Akzo), Luperox 610, Luperox 188, Luperox 844, Luperox 259, Luperox 10, Luperox 701, Luperox 11, Luperox 26, Luperox 80, Luperox 7, Luperox 270, Luperox P, Luperox 546, Luperox 554, Luperox 575, Luperox TANPO, Luperox 555, Luperox 570, Luperox TAP, Luperox TBIC, Luperox TBEC, Luperox JW, Luperox TAlC, Luperox TAEC, Luperox DC, Luperox 101, Luperox F, Luperox DI, Luperox 130, Luperox 220, Luperox 230, Luperox 233, and Luperox 531 (all manufactured by ARKEMA Yoshitomi).

Among these, by using an azo polymerization initiator having a molecular weight of 250 or more, a reaction proceeds without unevenness at a low temperature, and thus, formation of a high-strength film having a suppressed unevenness is promoted. More suitably, the molecular weight of the azo polymerization initiator is 250 or more, and still more suitably 300 or more.

Heating is carried out in an inert gas atmosphere such as nitrogen and argon, at an oxygen concentration of preferably 1000 ppm or less, and more preferably 500 ppm or less, and furthermore, at a temperature of preferably 50° C. to 170° C., more preferably 70° C. to 150° C., for a period of preferably 10 minutes to 120 minutes, and more preferably 15 minutes to 100 minutes.

The total content of the photocuring catalyst or the thermal polymerization initiator is preferably in the range of 0.1% by weight to 10% by weight, more preferably 0.1% by weight to 8% by weight, and particularly preferably 0.1% by weight to 5% by weight, based on the total solid content of the dissolution liquid for forming a layer.

In addition, in the present exemplary embodiment, since it is difficult to attain structural relaxation of the coating film due to crosslinking when the reaction proceeds too quickly, and thus, unevenness of the film and wrinkles easily occur. As a result, a curing method by heat, in which generation of radicals occurs relatively slowly is adopted.

In particular, by combining specific reactive group-containing charge transporting material with curing by heat, the structural relaxation of the coating film is promoted, and a protective layer 5 having excellent surface properties and states is easily obtained.

The film thickness of the protective layer 5 (outermost surface layer) is preferably from about 3 μm to 40 μm, and more preferably from 5 μm to 35 μm.

Electroconductive Substrate

The electroconductive substrate 4 may be a metallic plate, metallic drum, or metallic belt made of, for example, aluminum, copper, zinc, stainless steel, chromium, nickel, molybdenum, vanadium, indium, gold, platinum, or the like, or an alloy containing such a metal. Further, examples of the electroconductive substrate 4 include paper, a plastic film, or a belt on which an electroconductive compound such as an electroconductive polymer and indium oxide, a metal such as aluminum, palladium, or gold, or an alloy containing such a metal, is painted, evaporated or laminated.

The term "electroconductive" herein means that the volume resistivity is less than $10^{13}$ Ω·cm.

When the electrophotographic photoreceptor 7A is used for a laser printer, the surface of the electroconductive substrate 4 may preferably be made rough to have a centerline average roughness Ra of 0.04 μm to 0.5 μm in order to prevent interference fringes generated when a laser ray is radiated thereto. Further, when an incoherent light ray is used as a light source, at is not particularly necessary to make the surface rough to prevent interference fringes, and an electroconductive substrate 4 having Ra of 0.2 μm or less, and preferably 0.15 μm or less is used. In this case, defects caused by irregularities in the surface of the electroconductive substrate 4 are prevented from being generated; thus, the case is suitable for making the lifetime of the photoreceptor longer.

As a surface-roughening method, wet honing performed by spraying a support with a suspension, in which an abrasive agent is suspended in water, centerless grinding, in which a support is brought into contact with a rotating grinding stone to attain grinding continuously, an anodic oxidation treatment, or the like is preferable.

An additional surface-roughening method, a method in which electroconductive or semi-electroconductive powder is dispersed into a resin to form a layer on the support surface, thereby making a rough surface through the particles dispersed in the layer without roughening the surface of the electroconductive substrate 4, is used.

Here, the surface-roughening treatment based on anodic oxidation is a treatment in which aluminum is used as an anode to perform anodic oxidation in an electrolytic solution, thereby forming an oxide film on the aluminum surface. Examples of the electrolytic solution include a sulfuric acid solution and an oxalic acid solution. However, the porous anodic oxide film formed by the anodic oxidation itself is chemically active. Thus, it is preferable to perform a pore-sealing treatment of sealing the fine pores in the anodic oxide film by volume expansion based on hydration reaction in pressurized water vapor or boiling water (to which a salt of a metal such as nickel may be added), thereby changing the oxide to a hydrated oxide, which is more stable.

The film thickness of the anodic oxide film may preferably be from 0.3 μm to 15 μm.

The electroconductive substrate 4 may be subjected to a treatment with an aqueous acidic solution or boehmite treatment. A treatment with an acidic treatment solution containing phosphoric acid, chromic acid, and hydrofluoric acid is conducted as follows.

First, an acidic treatment solution is prepared. With respect to the blend ratio among phosphoric acid, chromic acid, and hydrofluoric acid in the acidic treatment solution, the amount of phosphoric acid, that of chromic acid, and that of hydrofluoric acid may be from 10% by weight to 11% by weight, from 3% by weight to 5% by weight, and form 0.5% by weight to 2% by weight, respectively, and the sum total concentration of these acids is preferably from 13.5% by weight to 18% by weight. The treatment temperature is preferably from 42° C. to 48° C. When the treatment temperature is kept at such a high temperature, a thicker coating film is more rapidly formed. The thickness of the coating film is preferably from 0.3 μm to 15 μm.

The boehmite treatment is preferably conducted by immersing the electroconductive substrate 4 into pure water at 90° C. to 100° C. for 5 minutes to 60 minutes, or by bringing the electroconductive substrate 4 into contact with heated water vapor of 90° C. to 120° C. for 5 minutes to minutes. The thickness of the coating film may be preferably from 0.1 μm to 5 μm. The resultant may be further subjected to an anodic oxidation treatment with an electrolyte solution containing adipic acid, boric acid, borate, phosphate, phthalate, maleate, benzoate, tartrate, or citrate which has lower coat-solubility.

Undercoat Layer

The undercoat layer 1 is constituted with, for example, inorganic particles in a binder resin.

As the inorganic particles, inorganic particles having a powder resistivity (volume resistivity) of $10^2$ Ω·cm to $10^{11}$ Ω·cm are preferably used.

As the inorganic particles having the above powder resistivity (volume resistivity), inorganic particles such as tin oxide, titanium oxide, zinc oxide, or zirconium oxide are preferably used, and zinc oxide is particularly preferably used.

The inorganic particles may be subjected to a surface treatment, and two or more kinds of the inorganic particles different from each other in the surface treatments or in the particle diameters may be used in a mixture.

The specific surface area of the inorganic particles is preferably 10 $m^2/g$ or more as determined by the BET method.

The volume average particle diameter of the inorganic particles is preferably in the range of 50 nm to 2000 nm (more preferably 60 nm to 1000 nm).

Furthermore, the undercoat layer 1 preferably contains an acceptor type compound in combination with inorganic particles.

The acceptor type compound is not limited as long as the characteristics are achieved. Preferable examples thereof include electron transporting materials, for example, quinone compounds such as chloranil and bromoanil; tetracycanoquinodimethane compounds; fluorenone compounds such as 2,4,7-trinitrofluorenone, and 2,4,5,7-tetranitro-9-fluorenone; oxadiazole compounds such as 2-(4-biphenyl)-5-(4-t-butylphenyl)-1,3,4-oxadiazole, 2,5-bis(4-naphthyl)-1,3,4-oxadiazole and 2,5-bis(4-diethylaminophenyl)-1,3,4-oxadiazole; and xanthone compounds; thiophene compounds; diphenoquinone compounds such as 3,3',5,5'-tetra-t-butyldiphenoquinone. In particular, compounds having an anthraquinone structure are desired. Additional desired examples thereof include acceptor type compounds having an anthraquinone structure, such as a hydroxyanthraquinone compound, an aminoanthraquinone compound, and an aminohydroxyanthraquinone compound. Specific examples thereof include anthraquinone, alizarin, quinizarin, anthrarufin, and purpurin.

The content of these acceptor type compounds is not limited as long as the characteristics are achieved. But the acceptor type compounds are contained in the amount in the range of preferably 0.01% by weight to 20% by weight, and more preferably 0.05% by weight to 10% by weight, based on the inorganic particles.

The acceptor compound may be just added to a coating liquid for forming an undercoat layer or may be adhered to the surfaces of the inorganic particles in advance.

Examples of the method for applying the acceptor compound onto the surfaces of the inorganic particles include a wet method and a dry method.

When the surface treatment is carried out by a dry method, the treatment is attained by stirring the inorganic particles by a mixer or the like that gives a large shearing force while dropping the acceptor compound directly thereon or dropping the acceptor compound dissolved in an organic solvent thereon, and spraying the compound or the compound dissolved in an organic solvent thereon together with dry air or nitrogen gas. The addition or spraying is conducted preferably at a temperature of the boiling point of the solvent or lower. After the addition or spraying, the resultant may be subjected to baking at 100° C. or higher. The baking is performed within a desired range of baking temperature and baking time.

Furthermore, in a wet method, the inorganic particles are stirred in a solvent, and dispersed therein by use of ultrasonic waves, a sand mill, an attritor, a ball mill or the like. The acceptor compound is added thereto, and stirred or dispersed, and then the solvent is removed, thereby conducting the treatment. The method for removing the solvent is filtration, or separation by distillation. After the removal of the solvent, the resultant may be subjected to baking at 100° C. or higher. A temperature condition for the baking and a period condition for the baking are not particularly restricted as long as desired electrophotographic characteristics are obtained. In the wet method, water contained in the inorganic particles may be removed before the addition of a surface treatment agent. For example, a method of removing the water while the particles are stirred and heated in the solvent used in surface treatment, or a method of removing the water by boiling the water and the solvent azeotropically may be used.

Moreover, the inorganic particles may be subjected to surface treatment before the acceptor compound is applied to the particles. The surface treatment agent may be any agent as long as the undercoat layer gains desired characteristics, and may be selected from known materials. Examples of the surface treatment agent include a silane coupling agent, a titanate coupling agent, an aluminum coupling agent, and a surfactant. In particular, a silane coupling agent is preferably used since the agent gives good electrophotographic characteristics. A silane coupling agent having an amino group is more preferably used.

The silane coupling agent having an amino group may be any agent as long as desired electrophotographic photoreceptor characteristics are obtained. Specific examples thereof include 3-aminopropyltriethoxysilane, N-2-(aminoethyl)-3-aminopropyltrimethoxysilane, N-2-(aminoethyl)-3-aminopropylmethyldimethoxysilane, and N,N-bis(2-hydroxyethyl)-3-aminopropyltriethoxysilane, but are not limited thereto.

The silane coupling agents may be used in a mixture of two or more kinds thereof. Examples of the silane coupling agent which may be used in combination of the silane coupling agent having an amino group include vinyltrimethoxysilane, 3-methacryloxypropyl-tris(2-methoxyethoxy) silane, 2-(3,4-epoxycyclohexyl) ethyltrimethoxysilane, 3-glycidoxypropyltrimethoxysilane, vinyltriacetoxysilane, 3-mercaptopropyltrimethoxysilane, 3-aminopropyltriethoxysilane, N-2-

(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane, but are not limited thereto.

Furthermore, the surface treatment method using these surface treatment agents may be any known method, for which a dry method or a wet method may be used. Application of the acceptor compound and surface treatment using a surface treatment agent such as a coupling agent may be carried out at once.

The content of the silane coupling agent based on the inorganic particles in the undercoat layer 1 is not limited as long as desired electrophotographic characteristics are obtained. The content is preferably from 0.5% by weight to 10% by weight based on the inorganic particles.

As the binder resin contained in the undercoat layer 1, any known resin that may form a favorable film and achieve desired characteristics may be used. For example, known compounds of polymeric resins including acetal resins such as polyvinyl butyral, polyvinyl alcohol resins, casein, polyamide resins, cellulose resins, gelatin, polyurethane, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol resins, phenol-formaldehyde resins, melamine resins, and urethane resins; and a known material such as a zirconium chelate compound, a titanium chelate compound, an aluminum chelate compound, a titanium alkoxide compound, an organic titanium compound, and a silane coupling agent may be used.

Further, as a binder resin that is contained in the undercoat layer 1, a charge transporting resin having a charge transporting group, an electroconductive resin such as polyaniline, or the like may be used.

Among these, a resin which is insoluble in a coating solvent for the upper layer is appropriate as a binder resin, and in particular, thermal curing resins such as a urea resin, a phenol resin, a phenol-formaldehyde resin, a melamine resin, a urethane resin, an unsaturated polyester resin, an alkyd resin, and an epoxy resin and a resin obtained by the reaction of at least one selected from polyamide resins, polyester resins, polyether resins, acrylic resins, polyvinyl alcohol resins, and polyvinylacetal resins with a curing agent are suitable.

In the case where these binder resins are used in combination of two or more kinds thereof, the mixing ratio is determined depending on the requirements.

In a coating solution for forming the undercoat layer, the ratio of the inorganic particles having their surfaces on which the acceptor compound is applied (acceptor-property-applied metal oxide) to the binder resin, or the ratio of the inorganic particles to the binder resin may be appropriately set as long as desired electrophotographic photoreceptor characteristics are obtained.

In addition, various additives may be added to the undercoat layer 1.

As the additives, known materials, for example, an electron transporting pigment such as a condensed polycyclic pigment and an azo pigment, a zirconium chelate compound, a titanium chelate compound, an aluminum chelate compound, a titanium alkoxide compound, an organic titanium compound, and a silane coupling agent, are used. The silane coupling agent is used for the surface treatment of the inorganic particles as described above; however, the agent may be further added, as an additive, into the coating liquid for forming an undercoat layer.

Specific examples of the silane coupling agent as the additive include vinyltrimethoxysilane, 3-methacryloxypropyltris(2-methoxyethoxy)silane, 2-(3,4-epoxycyclohexyl)ethyltrimethoxysilane, 3-glycidoxypropyltrimethoxysilane, vinyltrimethoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethylmethoxysilane, N,N-bis(2-hydroxyethyl)-3-aminopropyltriethoxysilane, and 3-chloropropyltrimethoxysilane.

Further, examples of the zirconium chelate compound include zirconium butoxide, zirconium ethyl acetoacetate, zirconium triethanolamine, acetylacetonate zirconium butoxide, ethyl acetoacetate zirconium butoxide, zirconium acetate, zirconium oxalate, zirconium lactate, zirconium phosphonate, zirconium octanate, zirconium naphthenate, zirconium laurate, zirconium stearate, zirconium isostearate, methacrylate zirconium butoxide, stearate zirconium butoxide, and isostearate zirconium butoxide.

Examples of the titanium chelate compound include tetraisopropyl titanate, tetra-n-butyl titanate, butyl titanate dimer, tetra(2-ethylhexyl) titanate, titanium acetylacetonate, polytitanium acetylacetonate, titanium octylene glycolate, an ammonium salt of titanium lactate, titanium lactate, an ethyl ester of titanium lactate, titanium triethanol aminate, and polyhydroxytitanium stearate.

Examples of the aluminum chelate compound include aluminum isopropylate, monobutoxyaluminum diisopropylate, aluminum butyrate, diethylacetoacetate aluminum diisopropylate, and aluminum tris(ethylacetoacetate).

These compounds may be used singly or as a mixture or polycondensate of plural compounds.

The solvent for preparing a coating liquid for forming the undercoat layer is selected from known organic solvents, for example, alcoholic solvents, aromatic solvents, halogenated hydrocarbon solvents, ketone solvents, ketone alcohol solvents, ether solvents, and ester solvents.

As the solvent, an ordinary organic solvent, for example specifically methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene are used.

Further, these solvents may be used singly or as a mixture of two or more kinds thereof. Any solvents may be used as a mixed solvent as long as the mixed solvent is able to dissolve a binder resin.

As the method for dispersing the inorganic particles when the coating liquid for forming an undercoat layer is prepared, a known method such as a roll mill, a ball mill, a vibrating ball mill, an attritor, a sand mill, a colloid mill, and a paint shaker is used.

Further, as the coating method used to provide the undercoat layer 1, an ordinary coating method such as a blade coating method, a wire bar coating method, a spray coating method, an extrusion coating method, a dip coating method, a bead coating method, an air knife coating method, and a curtain coating method is used.

The coating liquid for forming an undercoat layer obtained as described above is used to form the undercoat layer 1 on the electroconductive substrate.

Further, the Vickers hardness of the undercoat layer 1 is preferably 35 or more.

Incidentally, the thickness of the undercoat layer 1 may be set into any value as long as desired characteristics are obtained, but the thickness is preferably 15 μm or more, and more preferably from 15 μm to 50 μm.

Furthermore, the surface roughness (ten-point average roughness) of the undercoat layer 1 is preferably adjusted from ¼n (n is a refractive index of the upper layer) to ½λ with respect to the laser wavelength λ for exposure used.

In order to adjust the surface roughness, particles made of a resin or the like may be added to the undercoat layer. As the resin particles, silicone resin particles, crosslinkable polymethyl methacrylate resin particles, or the like are used.

The surface of the undercoat layer may be polished to adjust the surface roughness. As the polishing method, buff polishing, sandblast treatment, wet honing, grinding treatment or the like is used. In the case of using an incoherent light source such as an LED and an organic EL image array, a smooth surface may be used.

The undercoat layer 1 is obtained by drying the coating liquid for forming an undercoat layer as described above coated on the electroconductive substrate 4, but usually the drying is carried out at a temperature capable of evaporating the solvent and forming a film.

Charge Generating Layer

The charge generating layer 2 is a layer including a charge generating material and a binder resin. Further, the charge generating layer 2 may be formed as a deposited film containing no binder resin. It is preferable in the case of using an incoherent light source such as an LED and an organic EL image array.

The charge generating material include azo pigments such as bisazo and trisazo pigments, condensed aromatic pigments such as dibromoanthanthrone, perylene pigments, pyrrolopyrrole pigments, phthalocyanine pigments, zinc oxide, and trigonal selenium. Among these, metal phthalocyanine pigments and metal-free phthalocyanine pigments are preferably used as the charge generating material in order to apply for laser exposure in the near infrared region. Particularly, gallium hydroxyphthalocyanine disclosed in JP-A-5-263007, JP-A-5-279591, and the like, gallium chlorophthalocyanine disclosed in JP-A-5-98181 and the like, tin dichlorophthalocyanine disclosed in JP-A-5-11172, JP-A-5-11173, and the like, and titanylphthalocyanine disclosed in JP-A-4-189873, JP-A-5-43823, and the like are preferably used.

Furthermore, in order to apply for laser exposure in the near ultraviolet region, as the charge generating material, a condensed aromatic pigment such as dibromoanthanthrone; a thioindigo pigment, a porphyrazine compound, zinc oxide, trigonal selenium; bisazo pigments disclosed in JP-A-2004-78147 and JP-A-2005-181992; and the like are used.

On the other hand, in the case where an incoherent light source such as an LED and an organic EL image array, having a light-emitting center wavelength of 450 nm to 780 nm, is used, the charge generating material may be used, but from the viewpoint of the resolution, in the case where the photosensitive layer is used as a thin film having a thickness of 20 μm or less, the field strength in the photosensitive layer is high and decrease in charge due to charge injection from a substrate, that is, image defects, called black spots, easily occurs. This becomes noticeable when a charge generating material easily generating dark currents, which is a p-type semiconductor such as trigonal selenium and a phthalocyanine pigment, is used.

In contrast, in the case where an n-type semiconductor such as a condensed aromatic pigment, a perylene pigment, an azo pigment, and the like is used, dark currents are hardly generated, and image defects called black spots even with a thin film may be suppressed. It has been found that by forming a smooth undercoat layer on a smooth substrate using an incoherent light source such as an LED and an organic EL image array, having a light-emitting center wavelength of 450 nm to 780 nm, and further using an n-type charge generating material, an image is obtained, which does not cause image defects even when the photosensitive layer is made into a thin film having a thickness of 20 μm or less and has a high resolution over a long period of time.

In addition, determination of the n-type is conducted by the polarity of the flowing photocurrent using a time-of-flight method that is generally used, and a type in which electrons flow more easily than holes as a carrier is taken as an n-type.

The binder resin used in the charge generating layer 2 is selected from a wide range of insulating resins, or may be selected from organic photoconductive polymers such as poly-N-vinylcarbazole, polyvinylanthracene, polyvinylpyrene, and polysilane. Preferable examples of the binder resin include polyvinyl butyral resin, polyarylate resin such as a polycondensate made from a bisphenol and an aromatic bivalent carboxylic acid), a polycarbonate resin, a polyester resin, a phenoxy resin, a vinyl chloride-vinyl acetate copolymer, a polyamide resin, an acrylic resin, a polyacrylamide resin, a polyvinyl pyridine resin, a cellulose resin, a urethane resin, an epoxy resin, casein, a polyvinyl alcohol resin, and a polyvinyl pyrrolidone resin. These binder resins may be used singly or as a mixture of two or more kinds thereof. The blend ratio (by weight) of the charge generating material to the binder resin is preferably in the range of 10:1 to 1:10. The word "insulating" herein means $10^{13}$ Ω·cm or more in terms of volume resistivity.

The charge generating layer 2 is formed using a coating liquid for forming a charge generating layer, in which the above-mentioned charge generating material and binder resin are dispersed in a predetermined solvent. Further, it may be formed as a deposited film containing no binder resin, and particularly, a condensed-ring aromatic pigment and a perylene pigment is preferably used for the deposited film.

Examples of the solvent used for dispersion include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. These solvents may be used singly or as a mixture of two or more kinds thereof.

Incidentally, as a method for dispersing the charge generating material and the binder resin in the solvent, an ordinary method, such as a ball mill dispersing method, an attritor dispersing method, and a sand mill dispersing method is used. According to such a dispersing method, the crystal form of the charge generating material is prevented from being changed by dispersion.

Further, at the time of the dispersion, it is effective to adjust the average particle diameter of the charge generating material to be 0.5 μm or less, preferably 0.3 μm or less, and more preferably 0.15 μm or less.

Moreover, when the charge generating layer 2 is formed, an ordinary method such as a blade coating method, a wire bar coating method, a spray coating method, an extrusion coating method, a dip coating method, a bead coating method, an air knife coating method, and a curtain coating method is used.

The film thickness of the thus-obtained charge generating layer 2 is preferably from 0.1 μm to 5.0 μm, and more preferably from 0.2 μm to 2.0 μm.

Charge Transporting Layer

The charge transporting layer 3 is formed so as to contain a charge transporting material and a binder resin, or a charge transporting polymer material.

Examples of the charge transporting material include electron transporting compounds including quinone compounds such as p-benzoquinone, chloranil, bromanil, and anthraquinone; tetracyanoquinodimethane compounds; fluorenone compounds such as 2,4,7-trinitrofluorenone; xanthone compounds, benzophenone compounds, cyanovinyl compounds, and ethylene compounds; and hole transporting compounds including triarylamine compounds, benzidine compounds, arylalkane compounds, aryl-substituted ethylene compounds, stilbene compounds, anthracene compounds, and hydrazone compounds. These charge transporting materials may be used singly or in combination of two or more kinds thereof, but the invention is not limited thereto.

From the viewpoint of charge mobility, the charge transporting material is preferably a triarylamine derivative represented by the aforementioned structural formula (a-1), a benzidine derivative represented by the aforementioned structural formula (a-2), and a stilbene compound represented by the aforementioned structural formula (a-3).

Among the triarylamine derivatives each represented by the structural formula (a-1) and the benzidine derivatives each represented by the structural formula (a-2), triarylamine derivatives each having "$—C_6H_4—CH═CH—CH═C(R^{13})(R^{14})$" and benzidine derivatives each having "$—CH═CH—CH═C(R^{21})(R^{22})$", are preferable since they are excellent from the viewpoints that they are excellent in charge mobility, adhesiveness to the protective layer 5 (outermost surface layer), resistance to the residual image that occurs owing to the remaining hysteresis of a previous images (hereinafter also referred to as a "ghost"), and others.

Furthermore, as the charge transporting polymer material, known materials having charge transporting properties, such as poly-N-vinylcarbazole and polysilane are used. The polyester charge transporting polymer materials disclosed in JP-A-8-176293, JP-A-8-208820, and the like are particularly preferable. The charge transporting polymer materials may form a film independently, but may also be mixed with the above-described binder resin to form a film.

Examples of the binder resins for use in the charge transporting layer 3 include polycarbonate resins, polyester resins, polyarylate resins, methacrylic resins, acrylic resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone alkyd resins, phenol-formaldehyde resins, styrene-alkyd resins, poly-N-vinylcarbazole, and polysilane. The polyester charge transporting polymer material disclosed in JP-A-8-176293 and JP-A-8-208820, and the like may be also used. Among these resins, polycarbonate resins or polyarylate resins are preferable since the resins are excellent in compatibility with the charge transporting material.

These binder resins may be used singly or in combination of two or more kinds thereof. The blending ratio of the charge transporting material to the binder resin (by weight) is preferably from 10:1 to 1:5.

Further, a charge transporting polymer material may also be used as a charge transporting material. As the charge transporting polymer material, any one of known resins having a charge transporting property, such as poly-N-vinylcarbazole and polysilane may be used. In particular, the polyester charge transporting polymer materials disclosed in JP-A-8-176293 and JP-A-8-208820 are particularly preferable due to a high level of charge transporting property, as compared with other compounds. The charge transporting polymer materials may form a film independently, but may also be mixed with the above-described binder resin to form a film.

The charge transporting layer 3 is formed by using a coating liquid for forming a charge transporting layer containing the aforementioned components.

Examples of the solvent for use in the coating liquid for forming a charge transporting layer include ordinary organic solvents including aromatic hydrocarbons such as benzene, toluene, xylene, and chlorobenzene; ketones such as acetone and 2-butanone, halogenated aliphatic hydrocarbons such as methylene chloride, chloroform, and ethylene chloride; and cyclic or linear ethers such as tetrahydrofuran and ethylether. These solvents may be used singly or as a mixture of two or more kinds thereof. Further, as a method for dispersing the respective components, a known method is used.

As a coating method when the coating liquid for forming a charge transporting layer is coated on the charge generating layer 2, an ordinary method such as a blade coating method, a wire bar coating method, a spray coating method, an extrusion coating method, a dip coating method, a bead coating method, an air knife coating method, and a curtain coating method is used.

The film thickness of the charge transporting layer 3 is preferably from 5 μm to 50 μm, and more preferably from 10 μm to 30 μm.

As a charge transporting layer, the surface layer material of the present exemplary embodiment may be used.

Image Forming Apparatus (and Process Cartridge)

Hereinafter, the image forming apparatus (and a process cartridge) according to the present exemplary embodiment will be described in detail.

Figure 4:
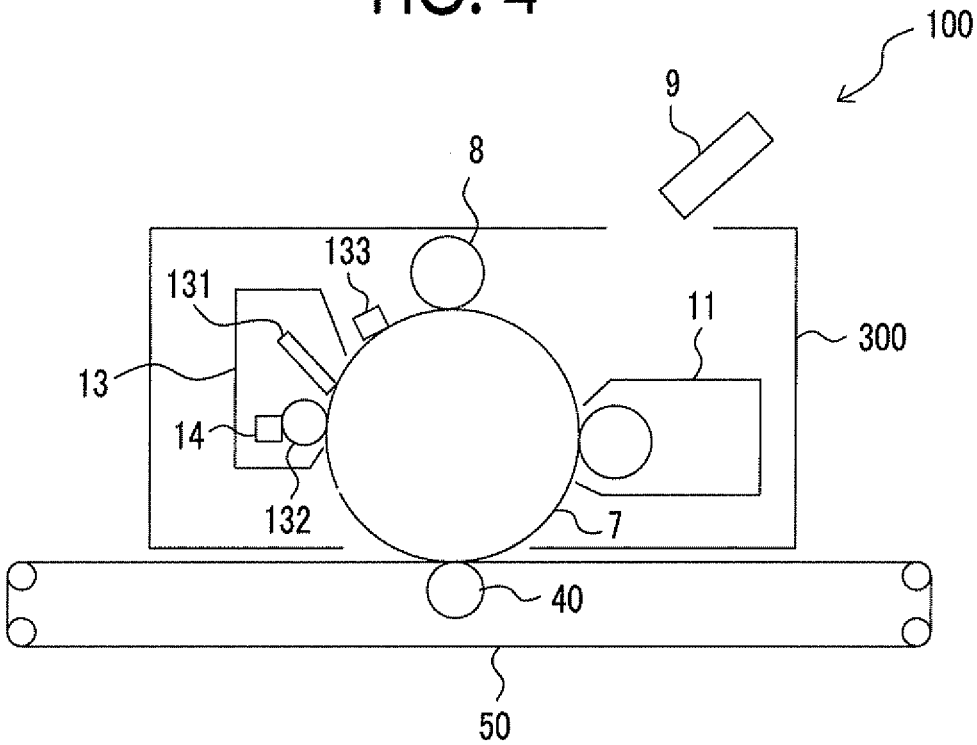
FIG. 4 is a schematic structural view showing an example of the image forming apparatus according to the present exemplary embodiment.

FIG. 4 is a schematic structural view showing an example of the image forming apparatus according to the present exemplary embodiment.

The image forming apparatus 100 according to the present exemplary embodiment is provided with a process cartridge 300 having an electrophotographic photoreceptor 7, an exposure device 9, a transfer device 40 (primary transfer device), and an intermediate transfer member 50 as shown in FIG. 4. Further, in the image forming apparatus 100, the exposure device 9 is arranged at a position where the exposure device 9 may radiate light onto the electrophotographic photoreceptor 7 through an opening in the process cartridge 300, and the transfer device 40 is arranged at a position opposite to the electrophotographic photoreceptor 7 by the intermediary of the intermediate transfer member 50. The intermediate transfer member 50 is arranged to contact partially the electrophotographic photoreceptor 7. Further, although not shown in the figure, the apparatus also includes a secondary transfer device that transfers a toner image transferred onto the intermediate transfer member 50 to a transfer medium (recording medium).

The process cartridge 300 in FIG. 4 carries, in its housing, the electrophotographic photoreceptor 7, a charging device 8, a developing device 11, and a cleaning device 13 as a unit. The cleaning device 13 has a cleaning blade (cleaning member), and the cleaning blade 131 is arranged so as to be in contact with the surface of the electrophotographic photoreceptor 7.

Furthermore, an example in which a fibrous member 132 (in a roll form) that supplies a lubricant material 14 onto the surface of the photoreceptor 7, and a fibrous member 133 (in a flat brush form) that assists cleaning is used is shown; however these members may or may not be used.

Hereinafter, the respective configurations of the image forming apparatus according to the present exemplary embodiment will be described.

Charging Device

As the charging device 8, for example, a contact type charger using an electroconductive or semiconductive charging roll, charging brush, charging film, charging rubber blade, charging tube, or the like is used. Further, known chargers per se, such as a non-contact type roller charger, and a scorotron charger and a corotron charger, each using corona discharge are also used.

A photoreceptor heating member, although not shown in the figure, may be further arranged around the electrophotographic photoreceptor 7 to raise the temperature of the electrophotographic photoreceptor 7, thus to decrease the relative temperature.

Exposure Device

The exposure device 9 may be an optical instrument for radiating a light ray such as a semiconductor laser ray, an LED ray, and a liquid crystal shutter ray into a predetermined image form onto the surface of the photoreceptor 7. The wavelength(s) of the light source may be a wavelength or wavelengths in the region of the spectral sensitivity of the photoreceptor. As the wavelengths of semiconductor lasers, near infrared wavelengths that are laser-emission wavelengths near 780 nm are predominant. However, the wavelength of the laser ray to be used is not limited to such a wavelength, and a laser having an emission wavelength near 600 nm, or a blue laser having any emission wavelength in the range of 400 nm to 450 nm may be used. In order to form a color image, it is effective to use a surface-emitting type laser light source capable of attaining a multi-beam output.

Here, as a light source of the exposure device 9, an incoherent exposure light source is preferably applied.

The incoherent exposure light source is a light source that irradiates incoherent light, and for example, as the incoherent exposure light source, an LED, an organic EL image array, or the like is adopted.

The area of the exposure spot of the surface of the electrophotographic photoreceptor exposed by the incoherent exposure light source is 1000 $\mu m^2$ or less, and the light-emitting center wavelength of the incoherent exposure light source is from 450 nm to 780 nm, preferably.

Next, an example of the exposure head will be described.

Figure 6:
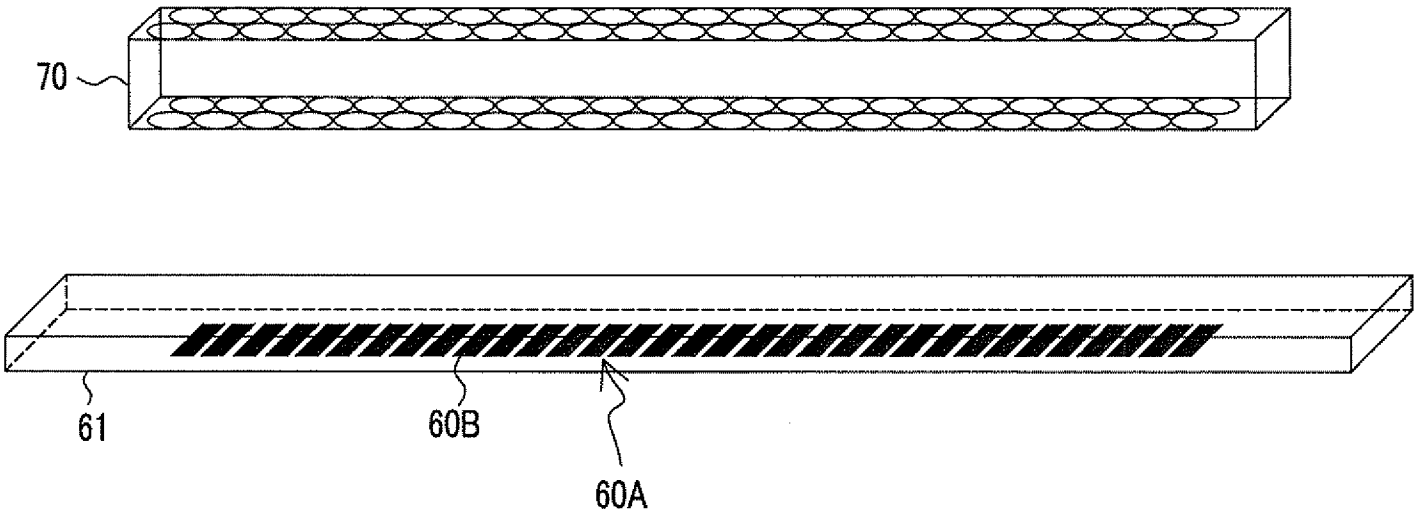
FIG. 6 is a schematic structural view showing an example of the exposure head.
Figure 7:
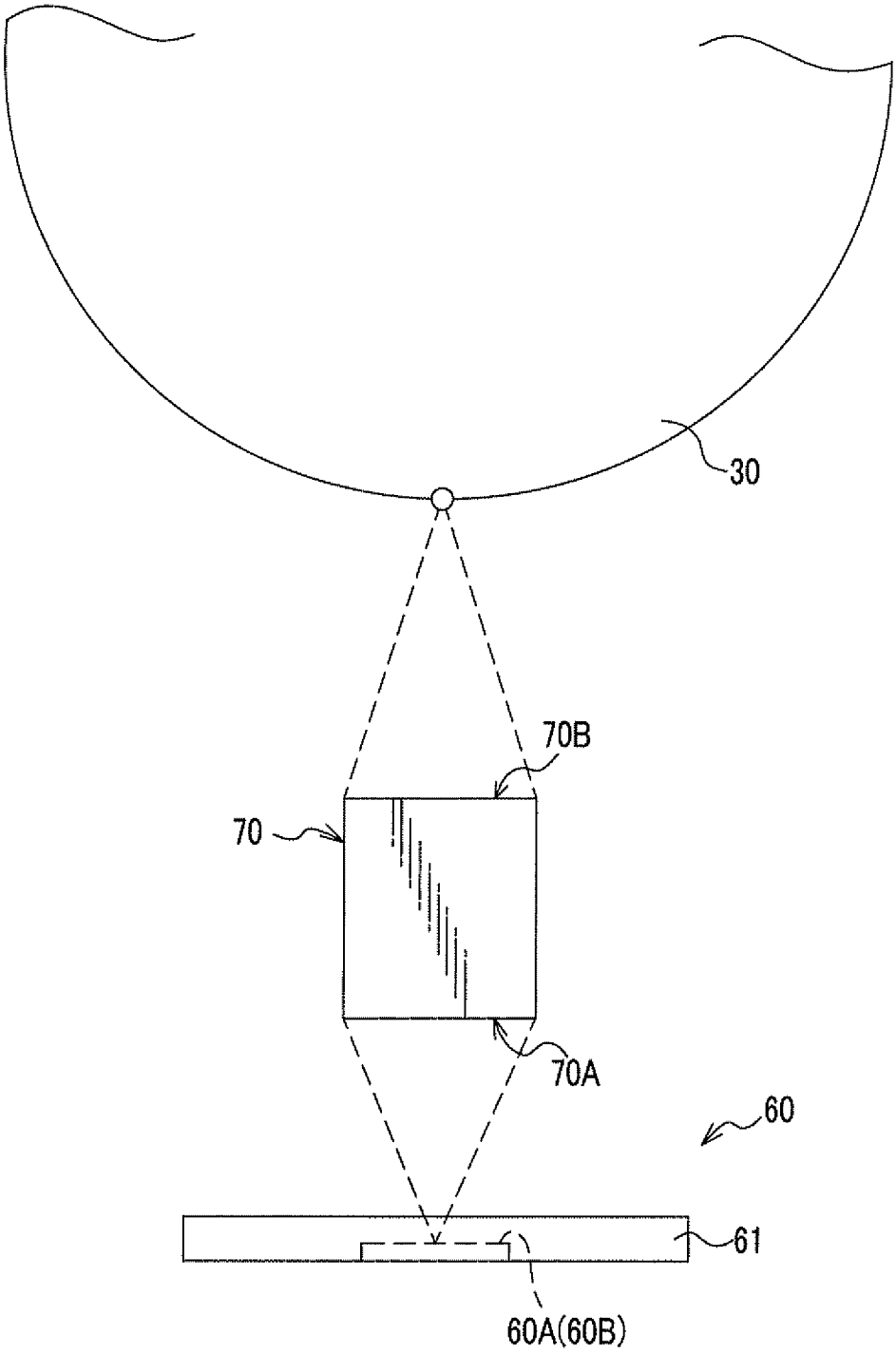
FIG. 7 is a schematic diagram showing the state of subjecting the electrophotographic photoreceptor to exposure by an exposure head.

FIG. 6 is a view showing an example of the exposure head, and FIG. 7 is a view showing a state in which the photoreceptor is subjected to exposure by the exposure head. Each of the exposure heads includes, as shown in FIGS. 6 and 7, for example, an organic EL element array (light-emitting element array 60B) and an image pickup unit (lens 70).

The light emitting element array 60B includes, for example, a light emitting unit constituted with an organic EL element (light-emitting element 60A), and a mounting substrate on which the organic EL element is mounted (corresponding to the light-emitting element array substrate 61 in FIG. 6).

The organic EL element array (light-emitting element array 60B) and the image pickup unit (lens 70) are held apart by a holding member such that the optical distance between the light-emitting unit (light-emitting element 60A) and the light incidence surface 70A of the image pickup unit is a working distance of the image pickup unit.

Here, the working distance of the image pickup unit refers to a distance between a focal point of the lens 70 used in the image pickup unit to the light incidence surface 70A of the image pickup unit.

Further, in the image pickup unit, the light emitted from the light-emitting unit is incident from the light incidence surface 70A and simultaneously, is output from the light emitting surface 70B to pickup an image at a predetermined position. That is, by pickup of the image using the light emitted from the light-emitting element 60A on the photoreceptor 30, the photoreceptor 30 is exposed to form a latent image (FIG. 7).

Here, the organic EL element array (light-emitting element array 60B) will be described.

The organic EL element array may be, for example, a so-called bottom-emission type that extracts light radiated from a light-emitting unit from the side of a mounting substrate (light-emitting element array substrate 61), but a top-emission type is also available.

The light-emitting unit is constituted with, for example, a group of singular light-emitting elements 60A. The light-emitting elements 60A are arranged linearly (in series) or in a zigzag form along the longitudinal direction of the mounting substrate (light-emitting element array substrate 61) to constitute the light-emitting unit. The light-emitting unit constituted with the group of the light-emitting elements 60A is at least as long as the image forming area of the photoreceptor 30.

Next, the image pickup unit (lens 70) will be described.

The image pickup unit is constituted with, for example, a lens array, in which plural rod lenses are arranged. As the lens array, specifically, for example, a refractive index dispersion lens array called an SELFOC lens array (SLA: SELFOC is a registered trademark of Nippon Sheet Glass Co., Ltd.) is most preferably used, but a combination of cylindrical lenses may be used. In addition, a microlens may be bonded to an individual organic EL element for a light source.

Developing Device

As the developing device 11, for example, a common developing device, in which a magnetic or non-magnetic single-component or two-component developer is contacted or not contacted for forming an image, may be used. Such a developing device is not particularly limited as long as it has the above-described functions, and may be appropriately selected according to the purpose. Examples thereof include a known developing device in which the single-component or two-component developer is applied to the photoreceptor 7 using a brush or a roller. Among these, the developing device using a developing roller retaining a developer on the surface thereof is preferable.

Hereinafter, a developer toner used in the developing device 11 will be described.

The developer may be a single-component developer formed of a toner alone or a two-component developer formed of a toner and a carrier.

Cleaning Device

As the cleaning device 13, a cleaning blade type device provided with the cleaning blade 131 is used.

Further, in addition to the cleaning blade type, a fur brush cleaning type and a type of performing developing and cleaning at once may also be used.

Transfer Device

Examples of transfer device 40 include known transfer chargers per se, such as a contact type transfer charger using a belt, a roller, a film, a rubber blade, or the like, a scorotron transfer charger, and a corotron transfer charger utilizing corona discharge.

Intermediate Transfer Member

As the intermediate transfer member 50, a form of a belt which is imparted with the semiconductivity (intermediate transfer belt) of polyimide, polyamideimide, polycarbonate, polyarylate, polyester, rubber, or the like is used. In addition, the intermediate transfer member may also take the form of a drum, in addition to the form of a belt.

In addition to the above-described devices, the image forming apparatus 100 may further be provided with, for example, a photoerasing device for photoerasing the photoreceptor 7.

Figure 5:
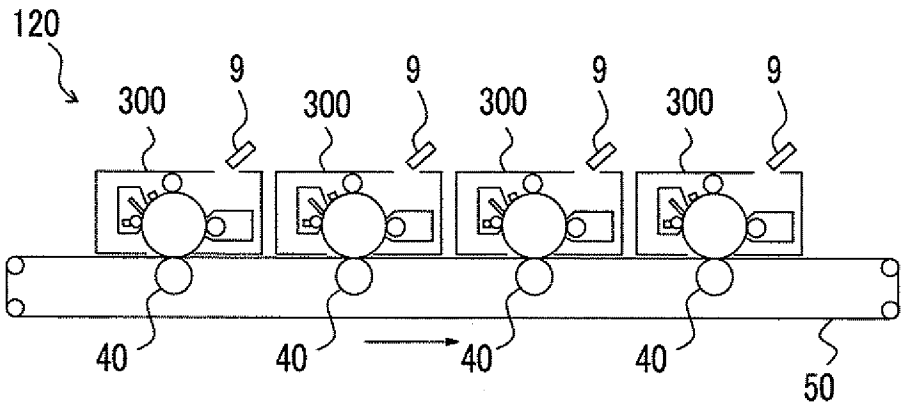
FIG. 5 is a schematic structural view showing another example of the image forming apparatus according to the present exemplary embodiment.

FIG. 5 is a schematic structural view showing another example of the image forming apparatus of the present exemplary embodiment.

The image forming apparatus 120 shown in FIG. 5 is a tandem type full color image forming apparatus equipped with four process cartridges 300. In the image forming apparatus 120, four process cartridges 300 are disposed parallel with each other on the intermediate transfer member 50, and one electrophotographic photoreceptor may be used for one color. Further, the image forming apparatus 120 has the same configuration as the image forming apparatus 100, except that it is a tandem type.

Further, the process cartridge according to the present exemplary embodiment is a process cartridge detachable from the image forming apparatus, which is provided with the electrophotographic photoreceptor according to the present exemplary embodiment, developing device, and a transfer device having an intermediate transfer member.

EXAMPLES

Hereinafter, the invention will be described in detail with reference to Examples below, but the present invention is not limited thereto. Further, the "parts" and "%" are based on weight unless otherwise specified.

Charge Transporting Materials

The charge transporting materials used will be shown below.

CTM-1

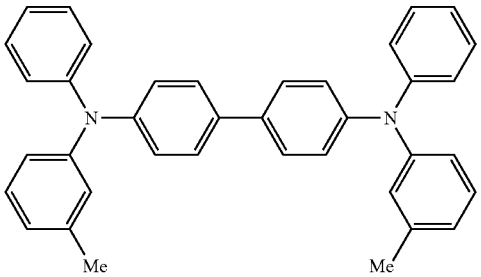

CTM-2

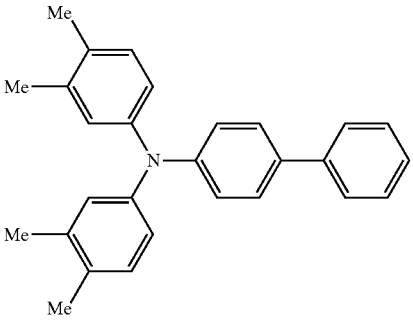

CTM-3

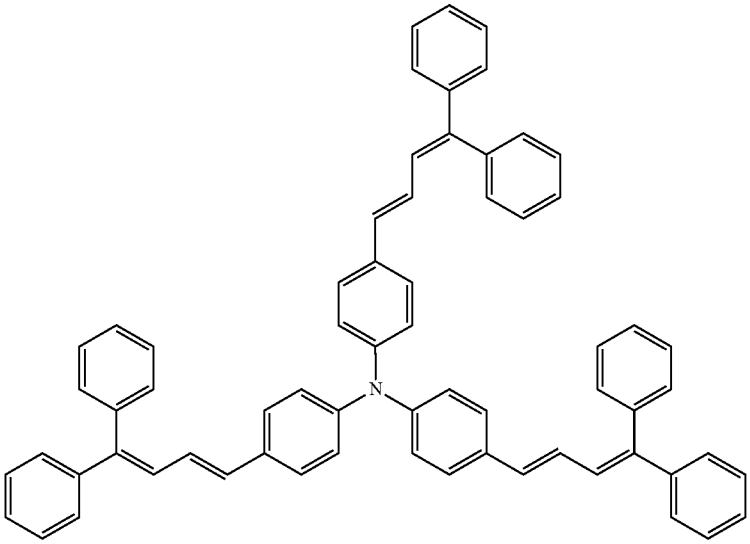

CTM-4

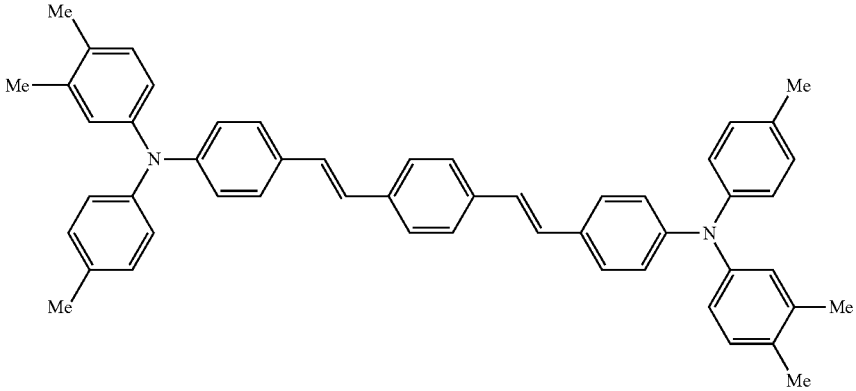

Specific Position Isomer Mixture

Synthesis Example 1

50 parts by weight of 1,1,1-tris(4-hydroxy phenyl)-ethane, 90 parts by weight of chloromethylstyrene (mixture of a meta position compound and a para position compound: CMS-P manufactured by AGC Seimi Chemical Co., Ltd.), 0.1 part by weight of nitrobenzene, 5 parts by weight of sodium iodide, 81 parts by weight of potassium carbonate, and 400 ml of methyl ethyl ketone are poured into a flask of 1 L, and the mixture is heat-refluxed in a nitrogen stream for fifteen hours. After completion of the reaction, methyl ethyl ketone is distilled away under a reduced pressure, 400 ml of toluene and 400 ml of water are then added thereto and dissolved therein, and an organic layer is separated. After the organic layer is further rinsed with water, the organic layer is dried with sodium sulfate and concentrated under a reduced pressure. This substance is refined by silica gel column chromatography, and 105 parts by weight of colorless oil (Exemplary compound 5 shown above) is obtained.

Synthesis Example 2

20 parts by weight of BIR-PC (manufactured by Asahi Organic Chemicals Industry Co., Ltd.), 52 parts by weight of chloromethylstyrene (mixture of a meta position compound and a para position compound: CMS-P manufactured by AGC Seimi Chemical Co., Ltd.), 0.1 part by weight of nitrobenzene, 2 parts by weight of sodium iodide, 47 parts by weight of potassium carbonate, and 300 ml of methyl ethyl ketone are poured into a flask of 1 L, and the mixture is heat-refluxed in a nitrogen stream for fifteen hours. After completion of the reaction, methyl ethyl ketone is distilled away under a reduced pressure, 400 ml of toluene and 400 ml of water are then added thereto and dissolved therein, and an organic layer is separated. After the organic layer is further rinsed with water, the organic layer is dried with sodium sulfate and concentrated under a reduced pressure. This substance is refined by silica gel column chromatography, and 25 parts by weight of colorless oil (Exemplary compound 11 shown above) is obtained.

Example 1

Production of Under Coating Layer 100 parts by weight of zinc oxide (average particle size: 70 nm, manufactured by Tayca Corporation, Specific surface area: 15 $m^2/g$) is stirred and mixed with 500 parts by weight of tetrahydrofuran, 1.3 parts by weight of silane coupling agent (KBM503 manufactured by Shin-Etsu Chemical Co., Ltd.) is added thereto, and the mixture is stirred for two hours. Thereafter, toluene is distilled away by distillation under a reduced pressure, baking is performed at 120° C. for three hours, and zinc oxide, the surface of which is treated with the silane coupling agent, is obtained.

110 parts by weight of surface-treated zinc oxide is stirred and mixed with 500 parts by weight of tetrahydrofuran, solution which is obtained by dissolving 1.0 parts by weight of purpurins derivative in 50 parts by weight of tetrahydrofuran is added thereto, and the mixture is stirred at 50° C. for five hours. Thereafter, zinc oxide, to which the purpurin derivative is provided, is filtered by filtration under a reduced pressure, and zinc oxide is further dried under a reduced pressure at 60° C. to obtain zinc oxide to which purpurin derivative is added.

38 parts by weight of solution which is obtained by dissolving 60 parts by weight of the zinc oxide provided with purpurin derivative, 13.5 parts by weight of curing agent (blocked isocyanate, Sumidur 3175 manufactured by Sumitomo Bayer Urethane Co., Ltd.), and 15 parts by weight of butyral resin (S-REC BM-1 manufactured by Sekisui Chemical Co., Ltd.) in 85 parts by weight of methyl ethyl ketone is mixed with 25 parts by weight of methyl ethyl ketone and dispersed by sand mill using glass bead with a size of 1 mmϕ for two hours, and dispersion liquid is obtained.

0.005 part by weight of dioctyltin dilaurate as catalyst and 45 parts by weight of silicone resin particles (Tospearl 145 manufactured by GE Toshiba Silicones Co., Ltd.) are added to the obtained dispersion liquid, and application liquid for the under coating layer is obtained. The application liquid is applied to an aluminum substrate with a diameter of 30 mm, a length of 340 mm, and a thickness of 1 mm by a dipping application method, dry curing at 170° C. for forty minutes is performed thereon, and the under coating layer 1 with the thickness of 18 μm is obtained. Ra is about 0.3 μm.

Production of Charge Generation Layer

Mixture of 15 parts by weight of hydroxygallium phthalocyanine which has diffraction peaks at least at positions, at which Bragg angles (2θ±0.2°) of an X-ray diffraction spectrum using a Cukα characteristic X-ray are 7.3°, 16.0°, 24.9°, and 28.0°, as a charge generation material, 10 parts by weight of vinyl chloride-vinyl acetate copolymer resin as binder resin (VMCH manufactured by Nippon Unicar Company Limited), and 200 parts by weight of n-butyl acetate is dispersed by sand mill using glass beads with a diameter of 1 mmϕ for four hours. 175 parts by weight of n-butyl acetate and 180 parts by weight of methyl ethyl ketone are added to the obtained dispersion liquid and stirred, and application liquid for the charge generation layer is obtained. The application liquid for the charge generation layer is dipping-applied to the under coating layer and dried at 100° C. for five minutes, and the charge generation layer with the film thickness of 0.2 μm is formed.

Production of Charge Transporting Layer 40 parts by weight of CTM-1 and 10 parts by weight of CTM-2 as the charge transporting layer and 55 parts by weight of PC(Z) as the binder resin (bisphenol Z polycarbonate resin manufactured by Mitsubishi Gas Chemical Company, Inc., viscosity-average molecular weight: 60000, weight-average molecular weight: 50000) are added to and dissolved in 800 parts by weight of chlorobenzene, and the application liquid for the charge transporting layer is obtained. The application liquid is applied to the charge generation layer and dried at 130° C. for forty five minutes, and the charge transporting layer with the film thickness of 15 μm is formed.

Production of Protective Layer 20 parts by weight of Exemplary compound 5, 10 parts by weight of CTM-1, and 0.2 part by weight of OTazo-15 (manufactured by Otsuka Chemical Co., Ltd., molecular weight: 354.4) are dissolved in 20 parts by weight of THF and 40 parts by weight of butyl acetate, and the liquid is applied to the charge transporting layer by extrusion coating. The applied substance is dried with air at a room temperature (25° C.) for thirty minutes, and the temperature is then raised from the room temperature (25° C.) to 160° C. at a speed of 10° C./minute in nitrogen with oxygen concentration of 200 ppm. Then, the resultant is subjected to a heat treatment at 160° C. for one hour and cured, and the protective layer with a film thickness of about 5 μm is formed. This is regarded as an electrophotographic photoreceptor 1.

Example 2

The processes until the application of the surface layer are performed in the same manner as the processes for the electrophotographic photoreceptor 1 other than that OTazo-15 is replaced with 0.5 part by weight of 1-hydroxy-cyclohexyl-phenyl-ketone (Irgacure 184 manufactured by BASF Japan Ltd.). The resultant is dried with air at a room temperature (25° C.) for thirty minutes and irradiated with light in nitrogen with oxygen concentration of 200 ppm under conditions of using a metal halide lamp of 160 W/cm at an irradiation distance of 120 mm with irradiation intensity of 500 mW/cm$^2$ for the irradiation time of 60 seconds, and the coated film is cured. Furthermore, the coated film is dried at 150° C. for twenty minutes, and the protective layer with the film thickness of about 5 μm is formed. This is regarded as an electrophotographic photoreceptor 2.

Example 3

The processes until the application of the protective layer are performed in the same manner as the processes for the electrophotographic photoreceptor 1 other than that OTazo-15 is not added. The resultant is dried with air at a room temperature (25° C.) for thirty minutes, and the photoreceptor is irradiated with an electron beam under conditions of an irradiation distance of 30 mm at electron beam acceleration voltage of 90 kV, at electron beam current of 2 mA for the electron beam irradiation time of 1.0 second while the photoreceptor is rotated in nitrogen with oxygen concentration of 20 ppm at a speed of 300 rpm. Immediately after the irradiation, the resultant is heated at 150° C. in nitrogen with oxygen concentration of 20 ppm and held for twenty minutes to complete the curing reaction, and the protective layer with the film thickness of about 5 μm is formed. This is regarded as an electrophotographic photoreceptor 3.

Comparative Example 1

The processes until the process for forming the charge transporting layer are performed in the same manner as the processes for the electrophotographic photoreceptor 1. 20 parts by weight of Compound (A) shown below instead of Exemplary compound 5, 10 parts by weight of CTM-1 and 0.2 part by weight of OTazo-15 (manufactured by Otsuka Chemical Co., Ltd., molecular weight: 354.4) are dissolved in 20 parts by weight of THE and 40 parts by weight of cyclopentyl methyl ether, and the mixture is applied to the charge transporting layer by extrusion coating. The mixture is dried with air at a room temperature (25° C.) for thirty minutes, and the protective layer is formed. This is regarded as a comparative electrophotographic photoreceptor 1. Crystallization occurrs in the protective layer of the comparative electrophotographic photoreceptor 1 during the air drying process, and the surface thereof slightly yields white turbidity.

Compound (A)

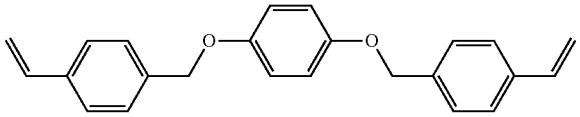

Compound (A) is synthesized as follows.

20 g of hydroquinone, 67 g of 4-chloromethylstyrene, 2 g of sodium iodide, 60 g of potassium carbonate, and 320 ml of methyl ethyl ketone are poured into a flask of 1 L and heat-refluxed for eight hours. After completion of the reaction, methyl ethyl ketone is distilled away under a reduced pressure, 500 ml of toluene and 300 ml of water are then added thereto and thermally dissolved therein, and an organic layer is separated from the liquid. After the organic layer is further rinsed with water, the organic layer is dried with sodium sulfate, and crystals generated by concentrating the organic layer is filtered to obtain 46 g of Compound (A).

Comparative Example 2

The processes until the process for forming the charge transporting layer are performed in the same manner as the processes for the electrophotographic photoreceptor 1. 20 parts by weight of Compound (B) (DPHA manufactured by Daicel Cytec Company Ltd.) shown below instead of Exemplary compound 5, 10 parts by weight of CTM-1, and 0.2 part by weight of OTazo-15 (manufactured by Otsuka Chemical Co., Ltd., molecular weight: 354.4) are dissolved in 20 parts by weight of THF and 40 parts by weight of cyclopentyl methyl ether, and the mixture is applied to the charge transporting layer by extrusion coating. The mixture is dried with air at a room temperature (25° C.) for thirty minutes, and the protective layer is formed. This is regarded as a comparative electrophotographic photoreceptor 2. Crystallization occurrs in the protective layer of the comparative electrophotographic photoreceptor 2 during the air drying process, and the surface thereof slightly yields white turbidity.

Compound (B)

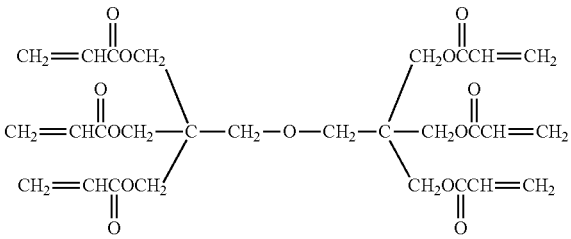

Example 4

The processes until the process for forming the charge transporting layer are performed in the same manner as the processes for the electrophotographic photoreceptor 1. 20 parts by weight of Exemplary compound 5, 10 parts by weight of CTM-1, 3 parts by weight of PTFE (Lubron L-2 manufactured by Daikin Industries Ltd.), and 0.3 part by weight of GF400 (manufactured by Toagosei Co., Ltd.) are dissolved in 20 parts by weight of THE and 40 parts by weight of cyclopentyl methyl ether and dispersed by an ultrasonic homogenizer. After completion of the dispersion, 0.2 part by weight of OTazo-15 (manufactured by Otsuka Chemical Co., Ltd., molecular weight: 354.4) is added thereto, and the resultant mixture is applied to the charge transporting layer by extrusion coating. The mixture is dried with air at a room temperature (25° C.) for thirty minutes, and the temperature is then raised from the room temperature (25° C.) to 160° C. at a speed of 10° C./minute in nitrogen with oxygen concentration of 200 ppm. Then, the resultant is subjected to a heat treatment at 160° C. for one hour and cured, and the protective layer with a film thickness of about 5 μm is formed. This is regarded as an electrophotographic photoreceptor 4.

Example 5

The processes until the process for forming the charge generation layer are performed in the same manner as the processes for the electrophotographic photoreceptor 1. 20 parts by weight of Exemplary compound 5, 10 parts by weight of CTM-1, 10 parts by mass of CTM-2, 0.2 part by weight of OTazo-15 (Otsuka Chemical Co., Ltd., molecular weight: 354.4) are dissolved in 20 parts by weight of THF and 20 parts by weight of cyclopentyl methyl ether, and the resultant liquid is applied to the charge generation layer by extrusion coating. The applied substance is dried with air at a room temperature (25° C.) for thirty minutes, and the temperature is then raised from the room temperature (25° C.) to 160° C. at a speed of 10° C./minute in nitrogen with oxygen concentration of 200 ppm. Then, the substance is subjected to a heat treatment at 160° C. for one hour and cured, and the protective layer with a film thickness of about 20 μm is formed. This is regarded as an electrophotographic photoreceptor 5.

Examples 6 to 14

The processes until the process for forming the charge generation layer are performed in the same manner as the processes for the electrophotographic photoreceptor 1. On the charge generation layer, the charge transporting layer and the protective layer with compositions shown in Table 1 are produced in the same manner as in Example 1, and electrophotographic photoreceptors 6 to 14 are produced.

In addition, the Exemplary compounds are synthesized based on the aforementioned synthesis method for the Exemplary Compounds Evaluation As for the prepared electrophotographic photoreceptors, the following items are evaluated. The results are shown in Tables 2 and 3.

Evaluation of Electrical Characteristics

As for the electrophotographic photoreceptor obtained as described above, before the test with image forming, using electrical characteristic evaluation apparatus manufactured by Fuji Xerox Co., Ltd., charging is performed at an initial potential of −700 V, and exposed at a wavelength of 780 nm with 3.7 mJ/m$^2$, and the surface potential (VL) after 30 msec is measured and evaluated according to the following criteria.

A smaller absolute value here means higher photoresponsiveness and more suitable for use at a high speed.

A: −80 V or more

B: less than −80 V and −110 V or more

C: less than −110 V and −140 V or more

D: less than −140 V

Evaluation of Image Quality

The photoreceptor as prepared in each of Examples is mounted on an ApeosPort-IV C5575 manufactured by Fuji Xerox Co., Ltd., and continuously subjected to evaluation of image quality below, under low temperature and low humidity (8° C., 20% RH), and high temperature and high humidity (28° C., 85% RH).

First, an image formation test is performed on 10000 sheets under a low temperature and low humidity environment (8° C., 20% RH), and the image quality (ghost, fogging, streaks, black spot, character resolution, and image deletion) of the 10000$^{th}$ sheet is evaluated. Further, during the image forming test, evaluation of blade squeal is also carried out. Further, after completion of the evaluation of image quality, the adherence onto the surface of the photoreceptor is evaluated.

Next, subsequently to evaluation of the image quality under the low temperature and low humidity environment, an image formation test of 10000 sheets is performed under a high temperature and high humidity environment (28° C., 85% RH), and the image quality (ghost, fogging, streaks, black spot, character resolution, and image deletion) of the 10000$^{th}$ sheet is evaluated. Further, during the image forming test, evaluation of blade squeal is also carried out. In addition, after completion of the evaluation of the image quality, adherence onto the surface of the photoreceptor and the abrasion amount of the photoreceptor are evaluated.

Ghost

Figure 8A:
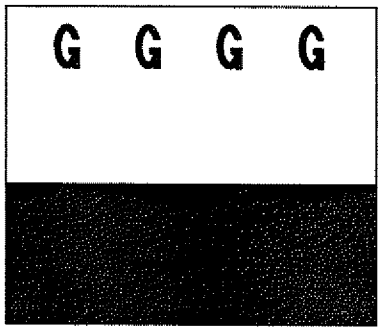
FIG. 8A to 8C are illustrative views showing the criteria for evaluation of a ghost.

With regard to ghost, a chart having a pattern of G and a gray area having an image concentration of 50% shown in FIG. 8A is printed, and the state where the letters G appear in the gray area of 50% is evaluated by visual observation.

A: The degree is from good to slightly conspicuous as in FIG. 8A.

Figure 8B:
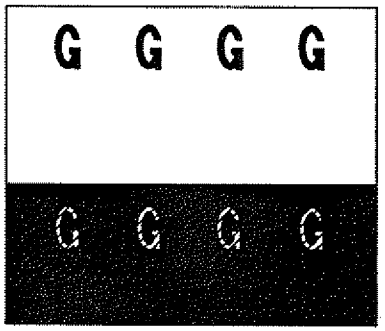

B: Slightly conspicuous as in FIG. 8B.

Figure 8C:
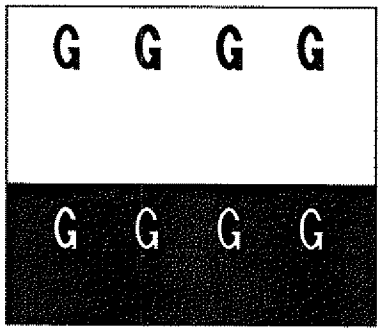

C: Clearly observed as in FIG. 8C.

Fogging

For the evaluation of the fogging, the degree of toner adhesiveness to the white area is evaluated by visual observation using the same sample as in the evaluation of a ghost above, and the presence or absence of the fogging (phenomenon that a toner is developed in the white area having no image) is examined.

A: There is no fogging.

B: There is slight fogging.

C: There is fogging having a damaging effect on image quality.

Streaks

For the evaluation of streaks, the degree of toner adhesiveness to the white area is evaluated by visual observation using the same sample as in the evaluation of a ghost above, and the presence or absence of the streaks (phenomenon that a toner remains linearly in the rotation direction of the photoreceptor and the image defects in the form of streaks are observed on paper) is examined.

A: There is no streak.

B: There are slight streaks.

C: There are streaks having a damaging effect on image quality.

Black Spots

For the evaluation of black spots, the degree of the image quality defects in the form of spots on the white area is evaluated by visual observation using the same sample as in the evaluation of a ghost above, and the presence or absence of the black spots (phenomenon that image defects in the form of spots having a size of about 1 mm are observed on the area having no image) is examined.

A: There is no generation of black spots.

B: More or less black spots are generated.

C: There are black spots at a problematic level in terms of image quality.

Character Resolution

For the evaluation of character resolution, a Kanji character "響" at a point size of 8 is printed and the resolution is observed visually and examined.

A: There is no collapse of the character.

B: There is slight collapse of the character.

C: The resolution is clearly poor.

Image Deletion

The image deletion is observed visually using the same sample as in the evaluation of a ghost above, and the presence or absence of the image deletion (phenomenon that an image end or a fine line or the like is thickened or thinned by the potential deletion on the surface of the photoreceptor) is examined.

A: There is no image deletion.

B: When image formation is continuously performed, there is no problem, but the image deletion occurs after being left for 1 day (24 hours).

C: Even when image formation is continuously performed, the image deletion occurs.

Adherence to Surface of Electrophotographic Photoreceptor

For the evaluation of adherence to the surface of the electrophotographic photoreceptor, the surface of the electrophotographic photoreceptor is examined by visual observation after image forming.

A: There is no adherence of the adherend.

B: There is partially adherence in the form of streaks; and the adherend is removed by gently wiping the surface of the electrophotographic photoreceptor with cloth soaked with isopropanol.

C: There is adherence in the form of streaks on the entire surface, and the adherend is not removed even by gently wiping the surface of the electrophotographic photoreceptor with cloth soaked with isopropanol.

Blade Squeal

The grade of the blade squeal during image formation (sound generated by the friction between the electrophotographic photoreceptor and the cleaning blade) is evaluated.

A: There is no squeal.

B: There is slight squeal.

C: There is clear squeal.

Abrasion Amount of Electrophotographic Photoreceptor

The film thickness of the electrophotographic photoreceptor after evaluation of the image quality as described above is measured using an eddy current type film thickness measurement device (manufactured by Fischer Instruments K. K.), and the difference (μm) between the same and the film thickness of the photoreceptor measured in advance is determined, thereby evaluating the abrasion amount of the electrophotographic photoreceptor.

A: less than 1.5 μm

B: 1.5 μm or more and less than 3 μm

C: 3 μm or more and less than 4 μm

D: 4 μm or more and less than 5 μm

E: 5 μm or more

Overall Evaluation

The evaluations of the image quality, the electrical characteristics, and the abrasion amount under low temperature and low humidity and under high temperature and high humidity are combined, and thus, overall evaluation of the electrophotographic photoreceptor and the image forming systems is conducted.

A: Particularly excellent

B: Excellent

C: Although there are some problems, there is no problem in practical use.

D: There is a problem in practical use.

TABLE 1

| | Charge transporting layer | | | | | | | Protective layer | | | |
|---|---|---|---|---|---|---|---|---|---|---|---|
| | Binder resin | | Charge transporting material | | | | | Specific non-charge transporting compound | | | |
| Photoreceptor | Type | Parts by weight | Type | Parts by weight | Type | Parts by weight | Film thickness (μm) | Type | Parts by weight | Type | Parts by weight |
| Photoreceptor 1 | PC(Z) | 55 | CTM-1 | 40 | CTM-2 | 10 | 15 | Exemplary compound 5 | 20 | — | — |
| Photoreceptor 2 | PC(Z) | 55 | CTM-1 | 40 | CTM-2 | 10 | 15 | Exemplary compound 5 | 20 | — | — |
| Photoreceptor 3 | PC(Z) | 55 | CTM-1 | 40 | CTM-2 | 10 | 15 | Exemplary compound 5 | 20 | — | — |
| Photoreceptor 4 | PC(Z) | 55 | CTM-1 | 40 | CTM-2 | 10 | 15 | Exemplary compound 5 | 20 | — | — |
| Photoreceptor 5 | — | — | — | — | — | — | — | Exemplary compound 5 | 20 | — | — |
| Photoreceptor 6 | PC(Z) | 55 | CTM-3 | 40 | CTM-4 | 10 | 15 | Exemplary compound 1 | 20 | — | — |
| Photoreceptor 7 | PC(Z) | 55 | CTM-3 | 40 | CTM-4 | 10 | 15 | Exemplary compound 2 | 20 | Exemplary compound 11 | 5 |
| Photoreceptor 8 | PC(Z) | 55 | CTM-3 | 40 | CTM-4 | 10 | 15 | Exemplary compound 3 | 20 | — | — |
| Photoreceptor 9 | PC(Z) | 55 | CTM-3 | 40 | CTM-4 | 10 | 15 | Exemplary compound 10 | 20 | — | — |
| Photoreceptor 10 | PC(Z) | 55 | CTM-1 | 40 | CTM-2 | 10 | 15 | Exemplary compound 11 | 20 | — | — |
| Photoreceptor 11 | PC(Z) | 55 | CTM-1 | 40 | CTM-2 | 10 | 15 | Exemplary compound 11 | 20 | — | — |
| Photoreceptor 12 | PC(Z) | 55 | CTM-1 | 40 | CTM-2 | 10 | 15 | Exemplary compound 11 | 20 | — | — |
| Photoreceptor 13 | PC(Z) | 55 | CTM-1 | 40 | CTM-2 | 10 | 15 | Exemplary compound 13 | 20 | — | — |
| Photoreceptor 14 | PC(Z) | 55 | CTM-1 | 40 | CTM-2 | 10 | 15 | Exemplary compound 14 | 20 | — | — |

TABLE 1-continued

| | | | | | | | | | | | |
|---|---|---|---|---|---|---|---|---|---|---|---|
| Comparative Photoreceptor 1 | PC(Z) | 55 | CTM-1 | 40 | CTM-2 | 10 | 15 | Compound (A) | 20 | — | — |
| Comparative Photoreceptor 2 | PC(Z) | 55 | CTM-1 | 40 | CTM-2 | 10 | 15 | Compound (B) | 20 | — | — |

| | Protective layer | | | | | | | | | |
|---|---|---|---|---|---|---|---|---|---|---|
| | Non-reactive charge transporting material | | | | Additive | | Polymerization initiator | | | |
| Photoreceptor | Type | Parts by weight | Type | Parts by weight | Type | Parts by weight | Type | Parts by weight | Curing method | Film thickness (μm) |
| Photoreceptor 1 | CTM-1 | 10 | — | — | — | | OTazo-15 | 0.2 | Thermal curing | 5 |
| Photoreceptor 2 | CTM-1 | 10 | — | — | — | | Irgacure 184 | 0.5 | Light and thermal curing | 5 |
| Photoreceptor 3 | CTM-1 | 10 | — | — | — | | — | | Electron beam + thermal curing | 5 |
| Photoreceptor 4 | CTM-1 | 10 | — | — | PTFE (Lubron L2) | 3 | OTazo-15 | 0.2 | Thermal curing | 5 |
| Photoreceptor 5 | CTM-1 | 10 | CTM-2 | 10 | Irganox 1076 | 0.3 | OTazo-15 | 0.2 | Thermal curing | 20 |
| Photoreceptor 6 | CTM-2 | 10 | CTM-3 | 5 | Irganox 1076 | 0.3 | OTazo-15 | 0.2 | Therma curingl | 5 |
| Photoreceptor 7 | CTM-1 | 10 | — | — | Irganox 1076 | 0.3 | OTazo-15 | 0.2 | Thermal curing | 5 |
| Photoreceptor 8 | CTM-4 | 10 | — | — | Irganox 1076 | 0.3 | OTazo-15 | 0.2 | Thermal curing | 5 |
| Photoreceptor 9 | CTM-1 | 10 | — | — | Irganox 1076 | 0.3 | OTazo-15 | 0.2 | Thermal curing | 5 |
| Photoreceptor 10 | CTM-1 | 10 | CTM-2 | 10 | Irganox 1076 | 0.3 | OTazo-15 | 0.2 | Thermal curing | 15 |
| Photoreceptor 11 | CTM-1 | 10 | CTM-3 | 5 | — | | OTazo-15 | 0.2 | Thermal curing | 10 |
| Photoreceptor 12 | CTM-1 | 10 | CTM-3 | 5 | PTFE (Lubron L2) | 5 | OTazo-15 | 0.2 | Thermal curing | 5 |
| Photoreceptor 13 | CTM-1 | 10 | CTM-3 | 5 | PTFE (Lubron L2) | 5 | OTazo-15 | 0.2 | Thermal curing | 5 |
| Photoreceptor 14 | CTM-1 | 10 | CTM-3 | | PTFE (Lubron L2) | 5 | OTazo-15 | 0.2 | Thermal curing | 7 |
| Comparative Photoreceptor 1 | CTM-1 | 10 | — | — | — | | OTazo-15 | 0.2 | Thermal curing | 5 |
| Comparative Photoreceptor 2 | CTM-1 | 10 | — | — | — | | OTazo-15 | 0.2 | Thermal curing | 5 |

40

TABLE 2

| | | | Low temperature and low humidity (8° C., 20% RH) | | | | | | | |
|---|---|---|---|---|---|---|---|---|---|---|
| | | | Image quality (10000-th image) | | | | | | | Blade squeal |
| Example | Photoreceptor | Electrical characteristics VL | Ghost | Fogging | Streaks | Black spot | Character resolution | Image deletion | Adherence on surface of photoreceptor | (during image formation) |
| Example 1 | Photoreceptor 1 | B | A | A | A | A | A | A | A | A |
| Example 2 | Photoreceptor 2 | B | B | A | A | A | A | A | A | A |
| Example 3 | Photoreceptor 3 | B | A | A | A | A | A | A | A | A |
| Example 4 | Photoreceptor 4 | A | A | A | A | A | A | A | A | A |
| Example 5 | Photoreceptor 5 | A | A | A | A | A | A | A | A | A |
| Example 6 | Photoreceptor 6 | A | A | A | A | A | A | A | A | A |
| Example 7 | Photoreceptor 7 | B | A | A | A | A | A | A | A | A |
| Example 8 | Photoreceptor 8 | A | A | A | A | A | A | A | A | A |
| Example 9 | Photoreceptor 9 | B | A | A | A | A | A | A | A | A |
| Example 10 | Photoreceptor 10 | A | A | A | A | A | A | A | A | A |
| Example 11 | Photoreceptor 11 | A | A | A | A | A | A | A | A | A |
| Example 12 | Photoreceptor 12 | B | A | A | A | A | A | A | A | A |
| Example 13 | Photoreceptor 13 | A | A | A | A | A | A | A | A | A |
| Example 14 | Photoreceptor 14 | A | A | A | A | A | A | A | A | A |
| Comparative Example 1 | Comparative Photoreceptor 1 | D | C | C | C | C | A | A | A | A |
| Comparative Example 2 | Comparative Photoreceptor 2 | D | C | C | C | C | A | A | A | A |

TABLE 3

| | | High temperature and high humidity (28° C., 85% RH) | | | | | | | | | |
|---|---|---|---|---|---|---|---|---|---|---|---|
| | | Image quality (10000-th image) | | | | | | | | | |
| Example | Photoreceptor | Ghost | Fogging | Streaks | Black spot | Character resolution | Image deletion | Adherence on surface of photoreceptor | Blade squeal (during image formation) | Abrasion amount | Overall Evaluation |
| Example 1 | Photoreceptor 1 | A | A | A | A | A | A | A | A | B | A |
| Example 2 | Photoreceptor 2 | B | A | A | A | A | A | A | A | B | B |
| Example 3 | Photoreceptor 3 | A | A | A | A | A | A | A | A | B | B |
| Example 4 | Photoreceptor 4 | A | A | A | A | A | A | A | A | B | A |
| Example 5 | Photoreceptor 5 | A | A | A | A | A | A | A | A | B | A |
| Example 6 | Photoreceptor 6 | A | A | A | A | A | A | A | A | B | A |
| Example 7 | Photoreceptor 7 | A | A | A | A | A | A | A | A | A | A |
| Example 8 | Photoreceptor 8 | A | A | A | A | A | A | A | A | A | A |
| Example 9 | Photoreceptor 9 | A | A | A | A | A | A | A | A | B | A |
| Example 10 | Photoreceptor 10 | A | A | A | A | A | A | A | A | B | A |
| Example 11 | Photoreceptor 11 | A | A | A | A | A | A | A | A | B | A |
| Example 12 | Photoreceptor 12 | A | A | A | A | A | A | A | A | A | A |
| Example 13 | Photoreceptor 13 | A | A | A | A | A | A | A | A | B | A |
| Example 14 | Photoreceptor 14 | A | A | A | A | A | A | A | A | B | A |
| Comparative Example 1 | Comparative Photoreceptor 1 | C | C | C | C | A | A | A | A | E | D |
| Comparative Example 2 | Comparative Photoreceptor 2 | C | C | C | C | A | A | A | A | E | D |

From the results above, it is found that in the present Examples, as compared with Comparative Examples, the surface potential of the photoreceptor is high, and favorable results are obtained with respect to evaluations of image quality (ghost, fogging, streaks, black spots, character resolution, and image deletion), blade squeal, and the abrasion amount of the photoreceptor.

Furthermore, when the present Example 4 having PTFE contained in the protective layer is compared with Example 1 having the same composition as in the present Example 4 except for having no PTFE in the protective layer, it is found that the electrophotographic photoreceptor of Example 4, which contains PTFE, has a low abrasion amount.

Evaluation on Solubility

Furthermore, solubility of the synthesized Exemplary compounds and Compound (C) shown below with respect to solvent is evaluated. Here, Compound (C) is a specific non-charge transporting compound which is not the specific position isomer mixture.

First, the Exemplary compounds and Compound (C) are respectively dissolved in tetrahydrofuran, and solubility of the solution is evaluated as follows.

1 g of Compound (C) is added to 10 ml of tetrahydrofuran at 20° C., the mixture is stirred for one hour, and solubility thereof is visually checked. A case where Compound (C) is dissolved is evaluated as A, a case where an insoluble part is slightly observed is evaluated as B, and a case where the solution yields white turbidity is evaluated as C.

In addition, solubility thereof when the solvent is changed from tetrahydrofuran to toluene, xylene, dichloroethane, chloroform, and butyl acetate is evaluated.

Compound (C)

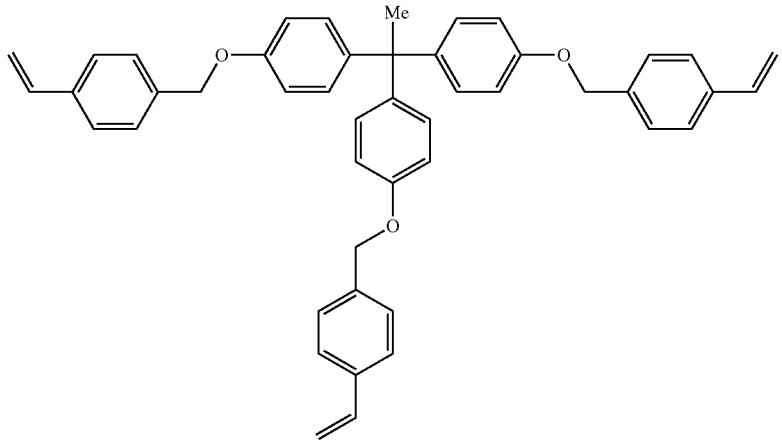

TABLE 4

| | Evaluation on solubility | | | | | |
|---|---|---|---|---|---|---|
| | Toluene | Tetrahydrofuran | Dichloroethane | Xylene | Chloroform | Butyl acetate |
| Exemplary compound 1 | A | A | A | A | A | A |
| Exemplary compound 2 | A | A | A | A | A | A |
| Exemplary compound 3 | A | A | A | A | A | A |
| Exemplary compound 5 | A | A | A | A | A | A |
| Exemplary compound 10 | A | A | A | A | A | A |
| Exemplary compound 11 | A | A | A | A | A | A |
| Exemplary compound 13 | A | A | A | A | A | B |
| Exemplary compound 14 | A | A | A | A | A | B |
| Compound (C) | B | A | A | B | A | C |

It is obvious from the above evaluation results that the exemplary compounds used in the examples exhibit excellent solubility with respect to solvent as compared with Compound (C).

Hereinafter, materials used in the respective examples and details of the abbreviations used in the tables will be shown.

Binder Resin

PC(Z): bisphonol Z polycarbonate resin (manufactured by Mitsubishi Gas Chemical Company, Inc., viscosity-average molecular weight: 60000, weight-average molecular weight: 50000)

Additives

PTFE: fluorine resin particles "Lubron L2 (manufactured by Daikin Industries Ltd.)"

Irganox 1076: hindered phenol system antioxidant "Irganox 1076 (manufactured by BASF Japan Ltd.)"

Polymerization Initiators

OTazo-15: thermal polymerization initiator "OTazo- (manufactured by Otsuka Chemical Co., Ltd., molecular weight: 354.4)"

Irgacure 184 (photopolymerization initiator "Irgacure 184 (manufactured by BASF Japan, Ltd.)"

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoreceptor comprising:

an electroconductive substrate;

a photosensitive layer that is provided on the electroconductive substrate; and an outermost surface layer, wherein the outermost surface layer is a layer made of a cured product of a composition that contains position isomer mixture of at least one kind among non-charge transporting compounds represented by Formulae (I) and (II) and at least one kind among non-reactive charge transporting materials:

(I)

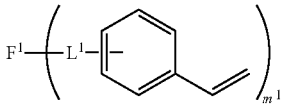

wherein in Formula (I), $F^1$ represents an $m^1$-valent organic group that does not have a charge transporting property and contains an aromatic ring; $L^1$ represents a divalent linking group that contains at least one kind selected from —C(═O)—O— and —O—; and $m^1$ represents an integer of 3 or more, (II)

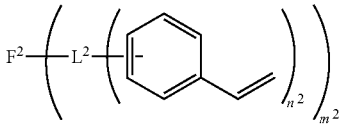

wherein in Formula (II), $F^2$ represents an $m^2$-valent organic group that does hot have a charge transporting property and contains an aromatic ring; $L^2$ represents a $(n^2+1)$-valent linking group that contains at least one kind selected from —C(═O)—O— and —O—; $m^2$ represents an integer of 2 or more; and $n^2$ represents an integer of from 2 to 3.

2. The electrophotographic photoreceptor according to claim 1:

wherein a group linked to $F^1$ in the compound represented by Formula (I) is a group represented by the following Formula (III) or (IV):

(III)

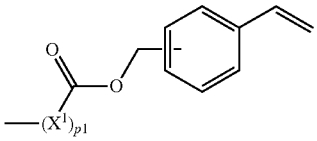

(IV)

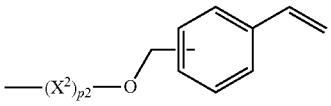

wherein $X^1$ and $X^2$ each independently represent a divalent linking group, and p1 and p2 each independently represent 0 or 1.

3. The electrophotographic photoreceptor according to claim 2, wherein the outermost surface layer contains resin particles.

4. The electrophotographic photoreceptor according to claim 3, wherein the resin particles are resin particles of at least one kind selected from tetrafluoroethylene resin, trifluoroethylene resin, hexafluoroethylene propylene resin, vinyl fluoride resin, vinylidene fluoride resin, difluoroethylene dichloride resin, and a copolymer thereof.

5. The electrophotographic photoreceptor according to claim 1, wherein a group linked to $F^2$ in the compound represented by Formula (II) is a group represented by the following Formula (V) or (VI):

(V)

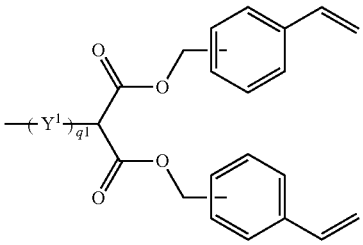

-continued (VI)

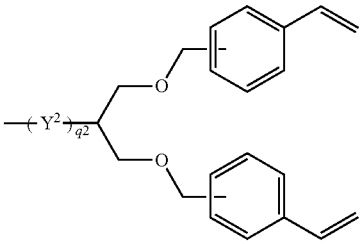

wherein $Y^1$ and $Y^2$ each independently represent a divalent linking group, and q1 and q2 each independently represent 0 or 1.

6. The electrophotographic photoreceptor according to claim 5, wherein the outermost surface layer contains resin particles.

7. The electrophotographic photoreceptor according to claim 6, wherein the resin particles are resin particles of at least one kind selected from tetrafluoroethylene resin, trifluoroethylene resin, hexafluoroethylene propylene resin, vinyl fluoride resin, vinylidene fluoride resin, difluoroethylene dichloride resin, and a copolymer thereof.

8. A process cartridge that is detachable from an image forming apparatus, the process cartridge comprising at least:

the electrophotographic photoreceptor according to claim 1.

9. An image forming apparatus comprising at least:

the electrophotographic photoreceptor according to claim 1;

a charging unit that charges a surface of the electrophotographic photoreceptor;

an electrostatic latent image forming unit that forms an electrostatic latent image on a charged surface of the electrophotographic photoreceptor;

a developing unit that develops the electrostatic latent image formed on the surface of the electrophotographic photoreceptor with a developer containing a toner to form a toner image; and a transfer unit that transfers the toner image to a transfer medium.

* * * * *